US011447362B2

(12) United States Patent
Zahn et al.

(10) Patent No.: US 11,447,362 B2
(45) Date of Patent: Sep. 20, 2022

(54) APPARATUS FOR SUPPORTING CONVOLUTELY WOUND LOGS OF WEB MATERIAL DURING CUTTING

(71) Applicant: Paper Converting Machine Company, Green Bay, WI (US)

(72) Inventors: Jonathon T. Zahn, Green Bay, WI (US); Cory L. Schubring, De Pere, WI (US); Cory P. Gussert, Pulaski, WI (US)

(73) Assignee: PAPER CONVERTING MACHINE COMPANY, Green Bay, WI (US)

( * ) Notice: Subject to any disclaimer, the term of this patent is extended or adjusted under 35 U.S.C. 154(b) by 283 days.

(21) Appl. No.: 16/914,888

(22) Filed: Jun. 29, 2020

(65) Prior Publication Data

US 2021/0002098 A1 Jan. 7, 2021

Related U.S. Application Data

(60) Provisional application No. 62/869,847, filed on Jul. 2, 2019.

(51) Int. Cl.
*B25B 5/00* (2006.01)
*B65H 75/18* (2006.01)
(Continued)

(52) U.S. Cl.
CPC ..... *B65H 75/18* (2013.01); *B25B 1/205* (2013.01); *B25B 5/04* (2013.01); *B26D 7/02* (2013.01);
(Continued)

(58) Field of Classification Search
CPC .. B25B 5/00; B25B 5/04; B25B 5/067; B25B 5/101; B25B 5/125; B25B 11/00;
(Continued)

(56) References Cited

U.S. PATENT DOCUMENTS 3,661,378 A * 5/1972 Dodge ..... B25B 1/205 269/286
5,038,647 A 8/1991 Biagiotti
(Continued)

OTHER PUBLICATIONS

International Search Report and Written Opinion for PCT/US2020/040111 dated Sep. 28, 2020.

*Primary Examiner* — Lee D Wilson
(74) *Attorney, Agent, or Firm* — Thompson Coburn LLP

(57) ABSTRACT

An apparatus supports a convolutely wound log of web material during cutting of the convolutely wound log, and includes a bottom support link operatively pivotally coupled to a support frame and a side support link operatively pivotally coupled to the support frame and the bottom support link. A flexible member operatively coupled to a distal end of the side support link extends tangentially from the side support link and curves away from the side support link and the bottom support link so that a portion of the flexible member is spaced away from the side support link and the bottom support link. The spaced away portion of the flexible member together with the side support link and the bottom support link at least in part define a support surface for supporting the convolutely wound log when the log is directed into the apparatus.

26 Claims, 17 Drawing Sheets

(51) Int. Cl.

| | |
|---|---|
| ***B65H 18/28*** | (2006.01) |
| ***B26D 7/02*** | (2006.01) |
| ***B25B 1/20*** | (2006.01) |
| ***B25B 5/04*** | (2006.01) |

(52) U.S. Cl.
CPC ..... *B65H 18/28* (2013.01); *B26D 2210/11* (2013.01); *B65H 2301/41484* (2013.01); *B65H 2701/1842* (2013.01)

(58) Field of Classification Search
CPC .. B25B 1/205; B25B 1/00; B26D 7/02; B65H 2301/41484
See application file for complete search history.

(56) References Cited

U.S. PATENT DOCUMENTS

| | | | | |
|---|---|---|---|---|
| 5,357,833 | A | 10/1994 | Biagiotti | |
| 5,647,259 | A | 7/1997 | Biagiotti | |
| 6,532,851 | B2 | 3/2003 | Moss et al. | |
| 10,272,585 | B1 | 4/2019 | Chike et al. | |
| 2002/0078811 | A1 | 6/2002 | Moss et al. | |
| 2009/0038458 | A1 | 2/2009 | Ridolfi et al. | |
| 2014/0190322 | A1 | 7/2014 | Pierce et al. | |
| 2016/0368158 | A1 | 12/2016 | Hsu | |
| 2017/0361484 | A1 | 12/2017 | Pardini | |
| 2018/0162005 | A1 | 6/2018 | Kettula et al. | |
| 2018/0162006 | A1* | 6/2018 | Kettula | B23D 47/04 |
| 2021/0002098 | A1* | 1/2021 | Zahn | B25B 5/04 |

* cited by examiner

APPARATUS FOR SUPPORTING CONVOLUTELY WOUND LOGS OF WEB MATERIAL DURING CUTTING

RELATED APPLICATION DATA

This application claims the benefit of U.S. provisional application Ser. No. 62/869,847, filed Jul. 2, 2019, the disclosure of which is incorporated by reference herein.

BACKGROUND

This disclosure is directed to an apparatus for supporting convolutely wound logs of web material during the cutting process, and more particularly to supporting logs of products such as bathroom tissue and kitchen toweling during the process of cutting the logs into rolls of a length suitable for sale. The log support apparatus may be one or more peripheral constraints for supporting a log during the cutting process. The peripheral constraint may be disposed in a lane of conveyor which directs a log to a log saw. The peripheral constraint may be adjustable for log diameter. Each peripheral constraint may have an adjustable lower portion with log support links made of a rigid material, and an adjustable upper portion comprised of a flexible material. As will become evident from the discussion that follows, the apparatus described herein provides the benefits of both rigid and flexible peripheral constraints, over a wider range of log diameters than is available with either rigid or flexible peripheral constraints, while minimizing the limitations of both rigid and flexible peripheral constraints. The wider range of log diameters is necessitated by the introduction of new consumer towel products with diameters up to about 203 mm (8 inches) by producers who desire to maintain the capability to produce current tissue and towel products with diameters ranging down to about 90 mm (3.5 inches) with minimal changeover time and few or no change parts required for product diameter changes.

By way of background, certain conventional peripheral constraint have rigid supports for supporting a log during cutting. A conventional peripheral constraint of a rigid type is disclosed in U.S. Pat. No. 6,532,851. A limitation of this peripheral constraint is the range of log diameters for which it can be adjusted, which is approximately 3.25 inches (82.5 mm) between the smallest diameter and the largest diameter. At the small end of the diameter range, the side links contact one another, preventing further adjustment. Beyond the large end of the diameter range, the side links lose contact with the right and left top product guides. On the other end of the spectrum, certain conventional peripheral constraints have flexible supports for supporting the log during cutting. Conventional peripheral constraints of a flexible type are disclosed in U.S. Pat. Nos. 5,357,833 and 5,647,259. Pending U.S. application Ser. No. 15/834,807 (US20180162006) describes some of the limitations of these types of prior art flexible peripheral constraints. To summarize the limitations, these types of flexible peripheral constraints have a limited range of log diameters to which they can be adjusted, which is such that the diameter at large end of the range is approximately twice the diameter at the small end of the range. This approximate range can be derived by simplifying the equation for the arc covered by each of the flexible strips at the large end of the diameter range to $\pi*D1/2$, where D1 is the large diameter; and by simplifying the equation for the arc covered by each of the flexible strips at the small end of the range to $\pi*D2$, where D2 is the small diameter. Because the length of the flexible strip is constant, setting the two arc lengths equal to one another simplifies to $D1=2*D2$. Beyond the small end of the diameter range, one or both flexible strips curl around the log's circumference and encroach on the opening for the log advancement member, while beyond the large end of the diameter range, the flexible strips lose contact with one another. Change parts are required to expand the diameter range, which take time to install resulting in lost productivity. Another limitation of these peripheral constraints is that they are bent sharply near the location at which they are connected to their supports. The sharp bend increases stress in the flexible strip. The sharp bend distorts the flexible strip from the preferred circular arc shape. Another limitation of these peripheral constraints is that they are not rigid beneath the log where support of the log's weight is needed; or they are flexible or have discontinuities in locations where support to oppose the force of the blade entering and exiting the log is needed.

A peripheral constraint which combined rigid elements and prior art flexible elements was disclosed in U.S. patent Ser. No. 10/272,585. During testing of a log saw with a peripheral constraint of that embodiment, it was discovered that, with some logs, as the blade exited the log after completing the cutting of a roll, the paper on the roll tended to be pushed by the force of the blade into the void between the side support link and the flexible member, resulting in decreased roll quality. The flexible member was also mounted such that its shape was not a continuous circular arc, which is the preferred shape for enveloping and supporting a log.

As will become evident from the description that follows, the peripheral constraints disclosed herein address the issues found in these conventional peripheral constraints.

DETAILED DESCRIPTION

The log saw may comprise a conveyor with at least one lane, each of which may be provided with at least one log advancement member; a saw blade (for instance, an orbital circular saw blade disposed on an arm); at least one peripheral constraint; and a saw house that encloses a cutting area within an interior of the saw house. The conveyor may be in accordance with U.S. patent Ser. No. 10/272,585, the disclosure of which is incorporated by reference. The arm and the saw house may be in accordance with pending U.S. application Ser. No. 16/395,369, the disclosure of which is incorporated by reference.

Figure 1:
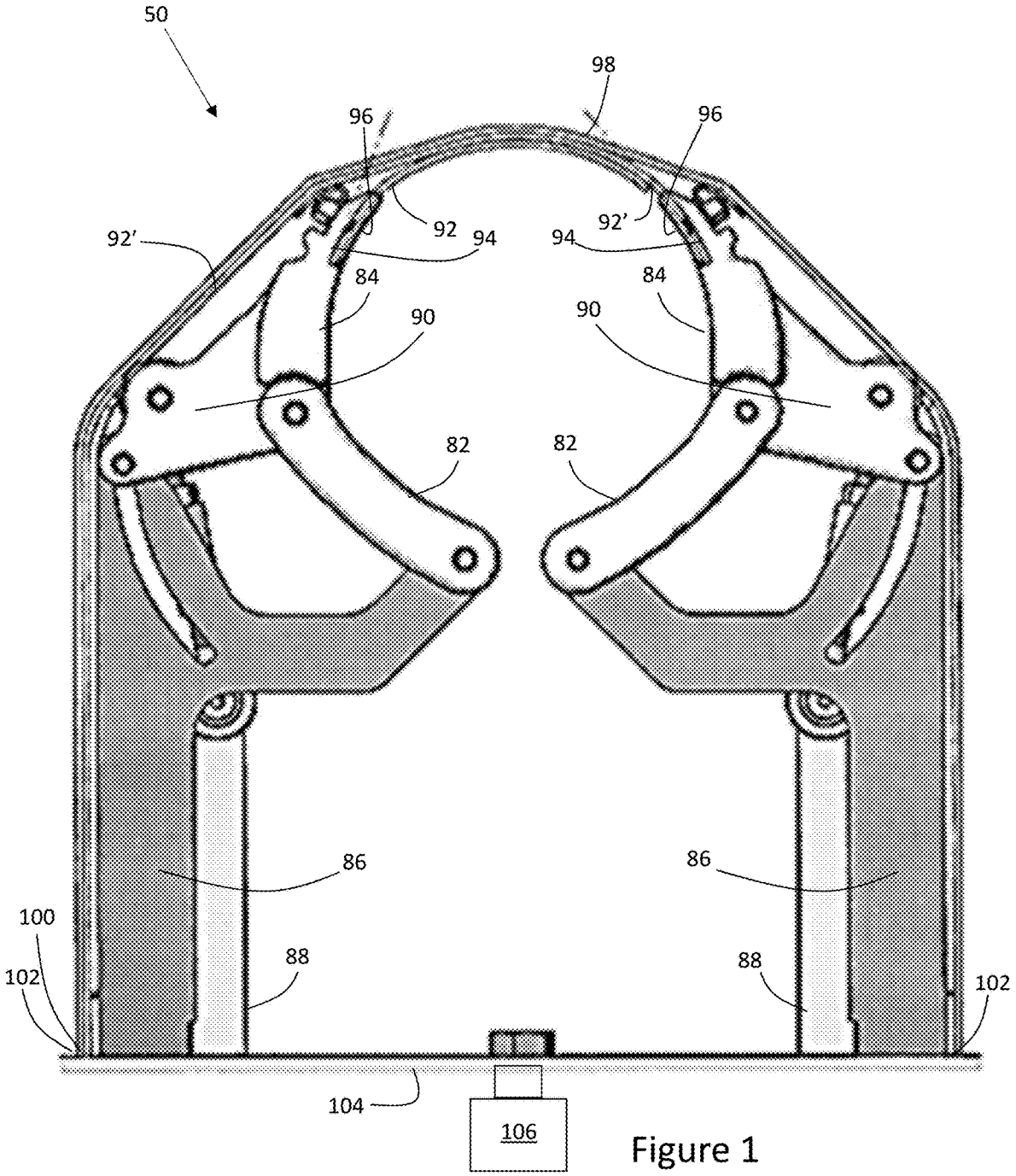
FIG. 1 is a front view of the peripheral constraint set for a small diameter log.
Figure 2:
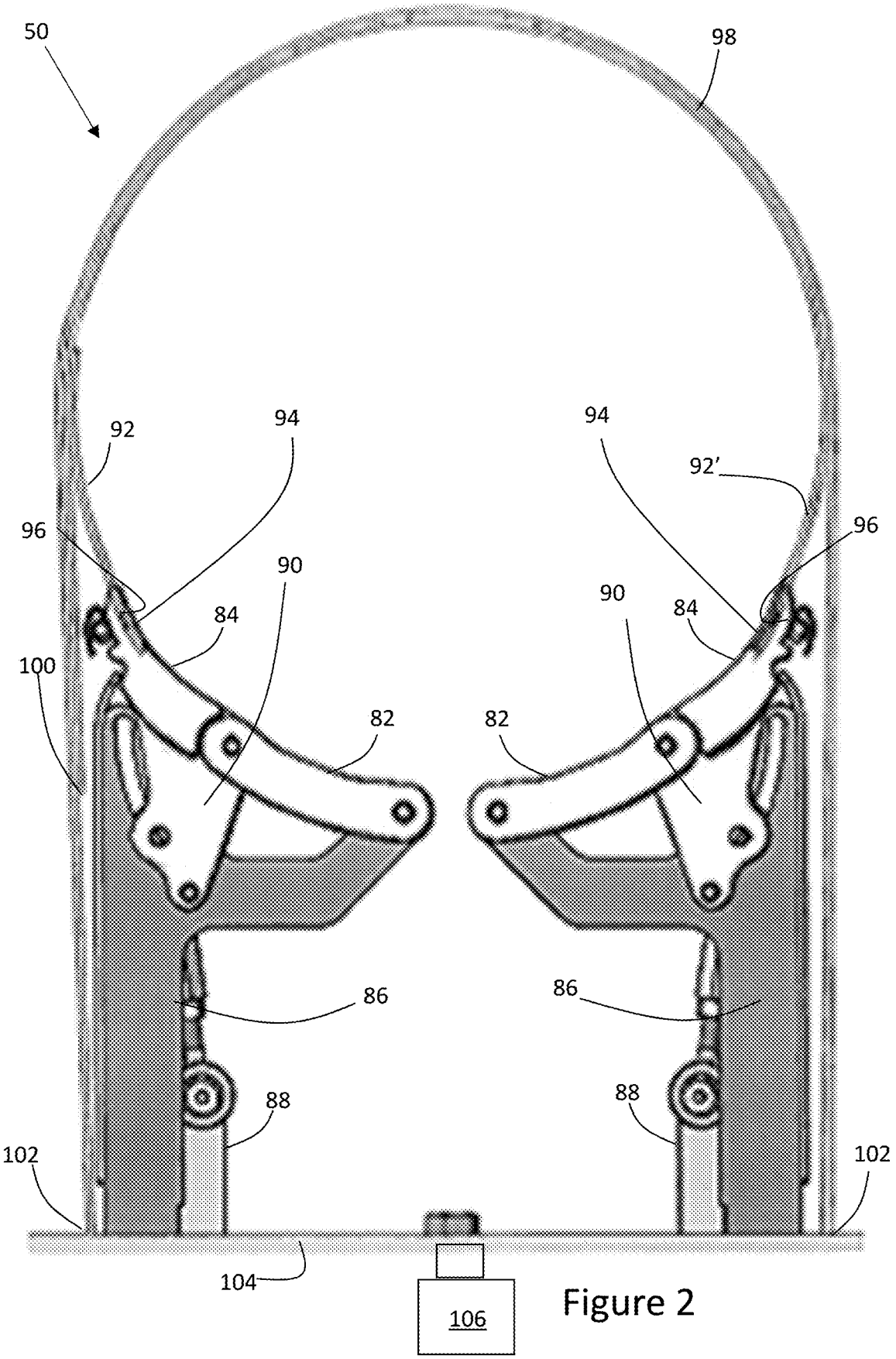
FIG. 2 is a front view of the peripheral constraint set for a large diameter log.
Figure 3:
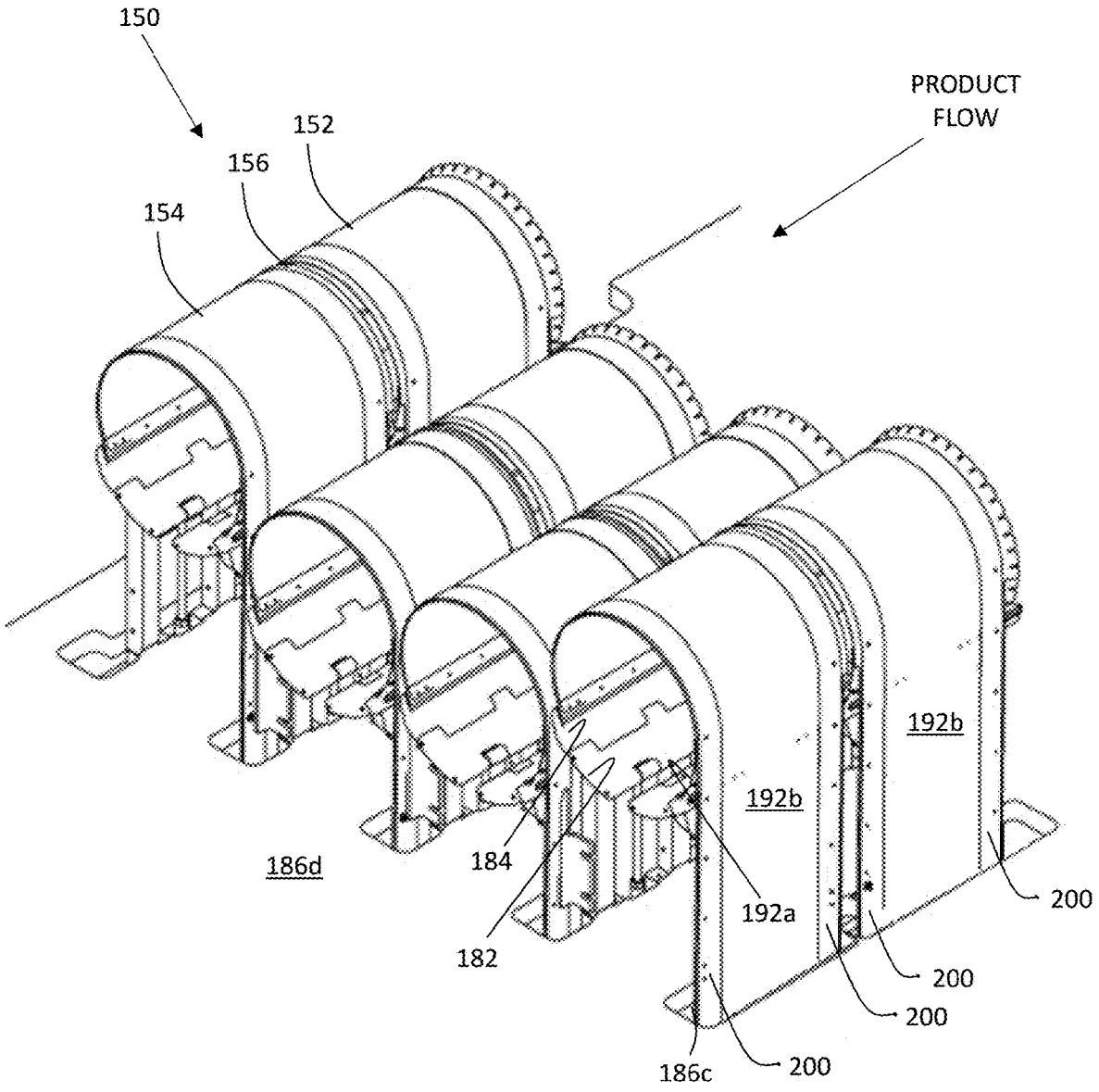
FIG. 3 is a perspective view of a portion of a four lane conveyor showing trailing and leading constraint units of the peripheral constraint of each lane, and in particular, the arrangement of a flexible member extending from one support link distal end around an outer portion of the constraint unit and extending through an opening in a lower support frame to a connection to a flexible member actuator (not shown).
Figure 4:
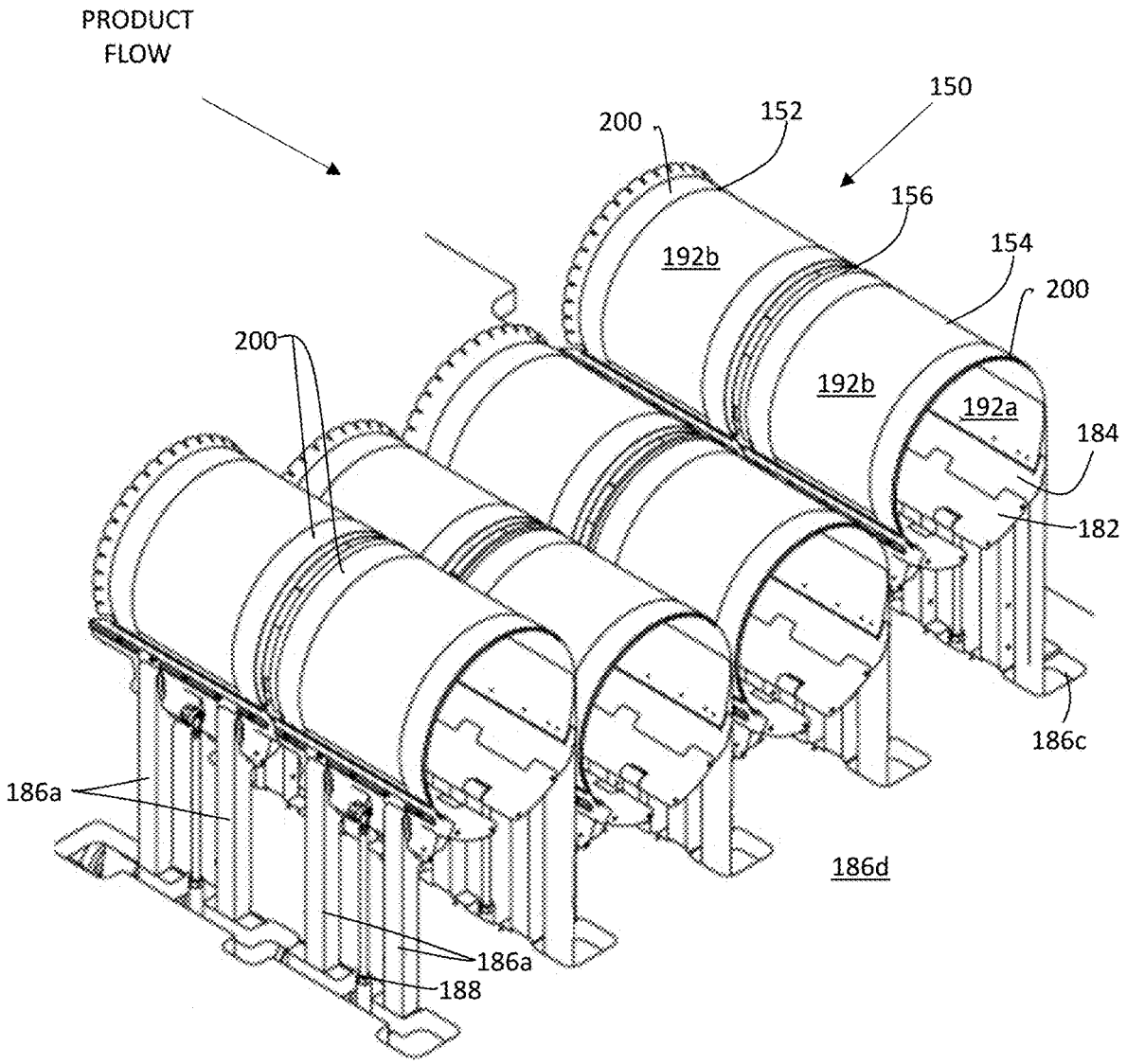
FIG. 4 is a perspective view of a portion of a four lane conveyor of FIG. 3 showing trailing and leading constraint units of the peripheral constraint of each lane, and in particular, the arrangement of a push pull control rod extending from the one support link and extending through the opening in the support frame to a connection to a push pull control rod actuator (not shown).
Figure 5:
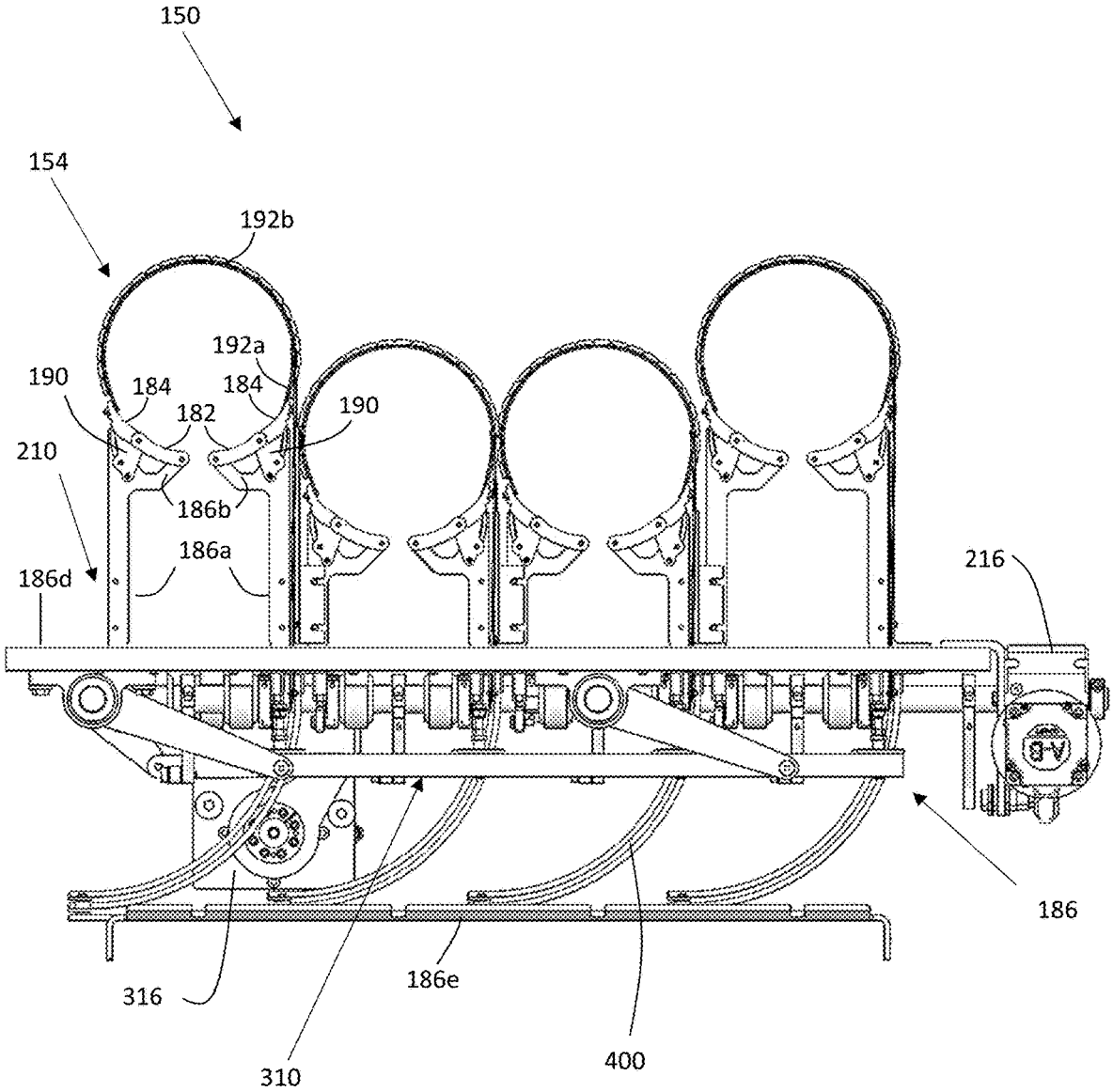
FIG. 5 is an elevation view of a downstream end of the peripheral constraints of the four lane conveyor of FIG. 3 showing additional detail of the push pull control rod actuator and the flexible member actuator.
Figure 6:
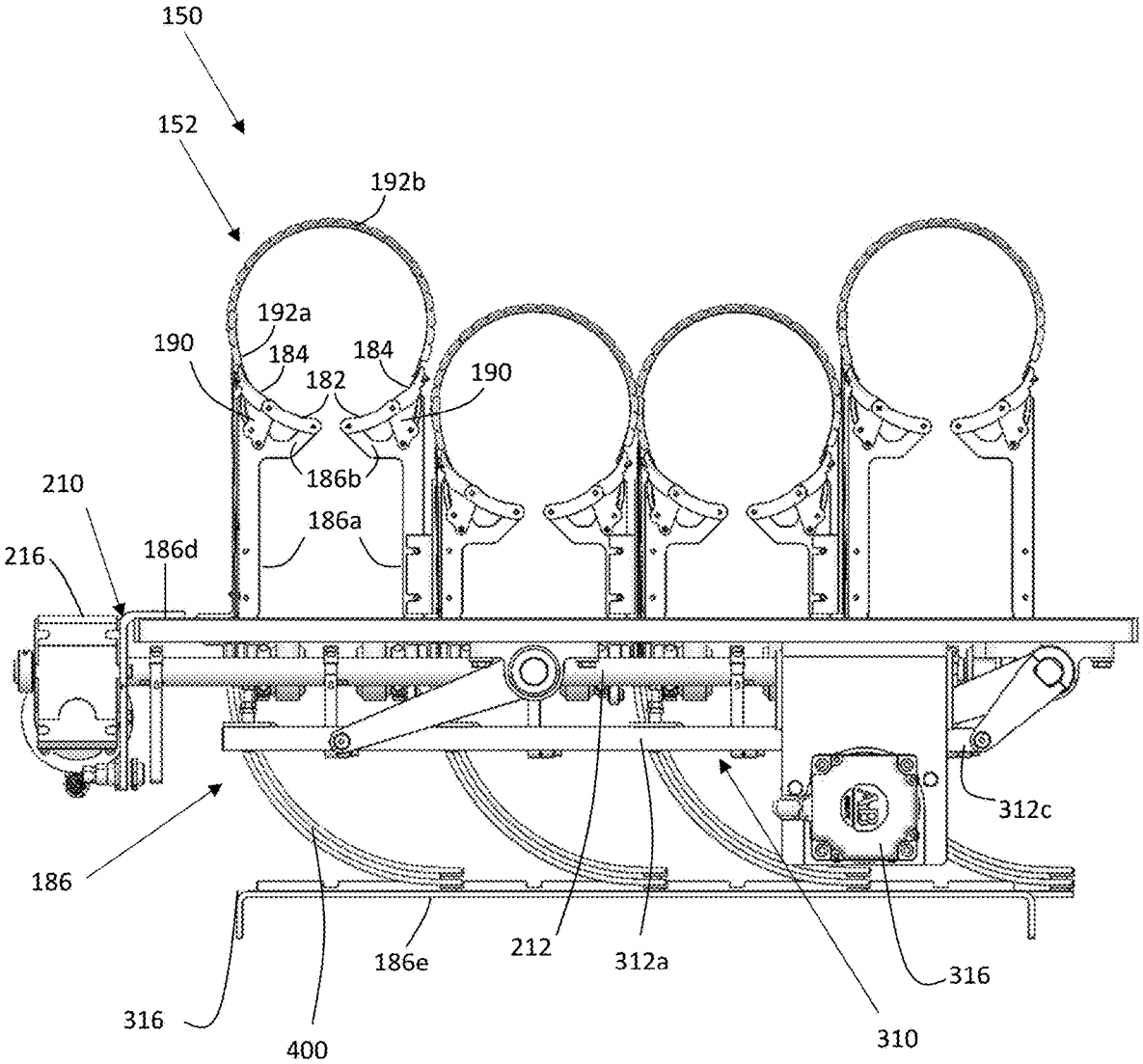
FIG. 6 is an elevation view of an upstream end of the peripheral constraints of the four lane conveyor of FIG. 3 showing additional detail of the push pull control rod actuator and the flexible member actuator.
Figure 7:
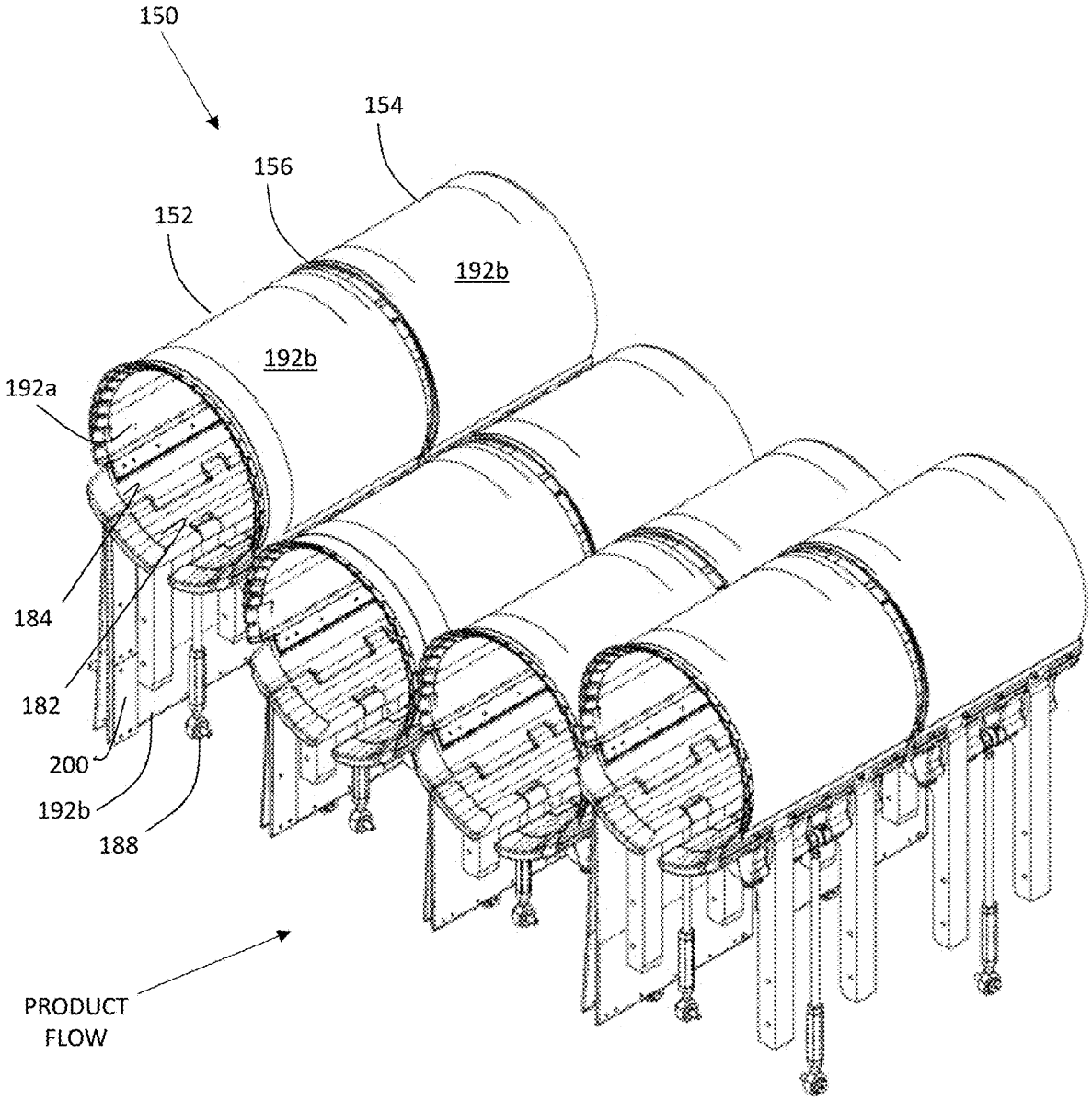
FIG. 7 is a perspective view of a portion of a four lane conveyor of FIG. 3 with the lower support frame removed to provide detail of a distal end of the push pull control rod and its connection to the push pull control rod actuator (not shown), and a distal end of the flexible member and its connection to the flexible member actuator (not shown).

By way of example and not in any limiting sense, FIGS. 1 and 2 show a peripheral constraint that may be used on a conveyor with one or more lanes, and FIGS. 3-19 show peripheral constraints that may be used on a conveyor with four lanes. Each peripheral constraint may engage the tissue log outer circumference or cylindrical surface area of the tissue log to help secure the tissue log during cutting by the saw. In addition, the peripheral constraint may provide contact friction with the tissue log outer circumference or cylindrical surface thereby providing drag force on the tissue log to counter the force of acceleration and deceleration during the log advancement motion. The drag force assists with control of the tissue log advancement and provides accurate log advancement for each index movement or incremental advancement. A peripheral constraint may be disposed on a log entry side of the cutting arm, and a companion peripheral constraint may be disposed at the roll exit side of the cutting arm. For instance, as shown in FIG. 10, the peripheral constraint may include a leading peripheral constraint unit and a trailing peripheral constraint unit.

Making reference to FIGS. 1-2, the depicted peripheral constraint 50 may be a single peripheral constraint of a one lane conveyor, or one of a plurality of peripheral constraints of a multilane conveyor. The depicted peripheral constraint 50 may be used as a leading peripheral constraint unit or a trailing peripheral constraint unit of a one lane or multilane conveyor. The peripheral constraint may have right and left bottom support links 82 and may have right and left side support links 84. The bottom support link may have a guide surface adapted to engage a region of a periphery of the convolutely wound log when the log is directed into the peripheral constraint. The guide surface of the bottom support link may be curved in a manner to approximate the average diameter (or a typical or a common diameter) of convolutely wound log to be conveyed in the conveyor. The side support link may have a guide surface adapted to engage another region of a periphery of the convolutely wound log when the log is directed into the peripheral constraint. The guide surface of the side support link may be curved in a manner to approximate the average diameter of convolutely wound log to be conveyed in the conveyor. The guide support surfaces may be textured to provide friction and drag to assist in controlling the log advancement motion. The right and left side support links 84 may be operatively mounted to a vertical portion of a lower support frame 86. The bottom support links 82 may be operatively pivotally connected to the lower support frame 86. The side support links 84 may be operatively pivotally connected to the bottom support links, and may be operatively slideably connected to the lower support frame, for example, via a linkage 90 that has a pin which cooperates in a curved slot of the vertical portion of the lower support frame. Each of the bottom and side support link pairs 82,84 may be pivotally connected with one another. While FIGS. 1-2 show right and left bottom support links and right and left side support links and linkages, the peripheral constraint may be constructed with one bottom support link and one side support link, or may be constructed with two bottom support links and one side support link depending upon the construction of the conveyor, the pusher, and the manner of advancement of the log in the conveyor.

A push/pull rod 88 may be connected to the linkage 90 and may be used to move the bottom and side support links 82,84, for example, with a linkage actuation assembly as described below in reference to FIGS. 13-15, to accommodate a range of product diameters. These support links and linkages 82,84,90 comprise the rigid portion of the peripheral constraint. Moving the linkage 90 upwards in the drawings decreases the diameter setting of the rigid portion peripheral constraint, while moving the linkage 90 downwards in the drawings increases the diameter setting. The bottom support links 82 and side support links 84 may be provided with a flare or lead-in at the log inlet side to allow for variation in the diameter or compressibility of the logs being cut, and to prevent damage to the log as it transitions into the peripheral constraint, particularly if the peripheral constraint is configured for use as a leading peripheral constraint unit in the conveyor lane.

The peripheral constraint side support link 84 may have a flexible member 90,92' extending substantially tangentially from the guide surface of the side support link 84 and curving away from the side support link 84 and the bottom support link 82 so that a portion of the flexible member is spaced away from the guide surface of the side support link and the guide surface of the bottom support link. Depending upon the configuration of the conveyor lane and the manner of advancement of the log in the conveyor, the flexible member 92,92' may curve around the log and engage a majority of the surface area of the log. For instance, the flexible member may extend from the distal end of the side support link, curve around the top of the log and extend along the outer surface of the log in a region diametrically opposite of the side support link, as may be the case in a peripheral constraint configured with one side support link and one or two bottom support links. FIGS. 1 and 2 show an embodiment of peripheral constraint with two flexible members 92,92' extending from a distal end of each side support link, substantially tangential to the surface thereof. The flexible member may include resilient banding overlapping and/or connected with the flexible member, or alternatively, the flexible member may be constructed with sufficient resiliency to maintain a curved shape to accommodate, engage and support the log advanced into the peripheral constraint. Accordingly, the flexible member together with the guide surface of the side support link and the guide surface of the bottom support link may at least in part define a support surface for supporting the convolutely wound log when the log is directed into the peripheral constraint.

To facilitate replacement of the flexible member, the flexible member 92,92' may be a separate part from the side support link. In the alternative, one flexible member may be of unitary construction with a side support link, or both flexible members may be of unitary construction with the side support links. In the embodiment in which the flexible members 92,92' are separate parts, the mounting may be accomplished by providing a plate 96 with threaded studs which protrude through holes in the flexible member and the side support link, and securing the plate with nuts. The side support links may be provided with a relief 94 for mounting the flexible member with the plate 96. The plate may be of thickness such that the combined thickness of the flexible member and the plate is equal to the depth of the relief, so that the surface of the plate 96 is substantially flush with the surface of the side support link 84 with the flexible member 92,92' positioned in the relief 94. The edge of the plate 96 may be adjacent to the edge of the relief 94, so as to minimize any gap at the transition between the surface of the side support link and the surface of the flexible member. The plate 96 may be provided with rounded corners so as to minimize damage to the log.

The flexible members 92,92' extending from the side support links may overlap one another, forming a circular arc. The flexible member 92' which is on top of the other flexible member 92 in the drawings when the flexible members overlap may be longer than the other flexible member 92 (the bottom flexible member). The flexible members 92,92' may have a flare or lead-in at the log inlet side to allow for variation in the diameter or compressibility of the logs being cut, particularly, when the peripheral constraint is configured as a leading peripheral constraint unit. The longer flexible member 92' may be mounted at the blade exit side, to maximize the consistency of log support where the blade exits the log. In the alternative, the shorter flexible member 92 may be mounted at the blade exit side, to provide additional support to resist the force of the blade exiting the log. A plurality of flexible members may be provided in an overlapping arrangement with a longer flexible member 98 overlapping the shorter flexible members 92,92'. The flexible members may include resilient banding or may be formed or constructed with sufficient resiliency to maintain a curved shape to accommodate, engage and support the log advanced into the peripheral constraint. The outer most overlapping flexible member may include resilient banding or may be formed or constructed with sufficient resiliency so that the underlying flexible members conform to the shape of the outer most overlapping flexible member. One or more of the flexible members may be of sufficient stiffness to resist being forced into an arc so that when not under control, one or more of the flexible members return to a flat or mostly flat shape. The surface of the flexible material should be such that contact with the log does not cause tearing or scuffing of the log. The flexible member may be a sheet of plastic, for example ultrahigh molecular weight polyethylene (UHMW-PE) about 1.5 mm (0.06 inches) thick, rubber, thin gauge metal, or belting material. When under control, the flexible members are forced into the shape of a circular arc. This circular arc shape conforms to the cylindrical surface of the log for firm and consistent support to tissue logs during the cutting process.

The diameter of the flexible portion of the peripheral constraint may be controlled by directly controlling an end 100 of the flexible member 92', which is opposite the end connected to the side support link 84, and an end 102 of the top flexible member 98, for example, by operative connection to a frame or linkage 104 which is operatively connected to an actuator 106, for example a pneumatic cylinder or a motor, for moving (e.g., linearly/rotatably) the frame or linkage up and down. Moving the frame or linkage 104 (e.g., linearly/rotatably) down decreases the diameter setting of the flexible portion 92,92',98 of the peripheral constraint, while moving the frame or linkage (e.g., linearly/rotatably) up increases the diameter setting. The actuator may comprise a servo motor provided with a torque limit setting, such that if a log larger or firmer than expected entered the peripheral constraint, the flexible portion of the peripheral constraint would be permitted to open until the torque reduced below the torque limit. In the alternative, the diameter of the upper portion of the peripheral constraint may be controlled by applying force to an area near top of the overlapping flexible members with an additional flexible member; this additional flexible member may be of a less stiff material than the overlapping flexible members.

Alternative embodiments of the peripheral constraints may be contemplated. By way of example and not in any limiting sense, the peripheral constraint may be provided with bottom support links, from the end of each of which a flexible member extends substantially tangential to the surface. Also, the peripheral constraint may be provided with two bottom and one side support links, with one flexible member extending substantially tangential to the surface of the side support link. The peripheral constraint may include a second flexible member extending substantially tangential to the surface of the bottom support link which does not have a side support link connected to it. The peripheral constraint may be provided with one bottom and one side support link on one side, with various combinations of flexible members of the prior art or of the present disclosure on that side and/or the other side. By way of example and not in any limiting sense, the longer flexible member may be connected to the actuator with a compliant member or be provided with a compliant section, such that if a log larger or firmer than expected entered the peripheral constraint, the flexible portion of the peripheral constraint would be permitted to open to a diameter larger than its current diameter setting. By way of example and not in any limiting sense, the longer flexible member may comprise a compliant material, such that if a log larger or firmer than expected entered the peripheral constraint, the flexible portion of the peripheral constraint would be permitted to open to a diameter larger than its current diameter setting.

By way of example and not in any limiting sense, FIGS. 3-19 show another embodiment of a peripheral constraint 150 as used in connection with a four lane conveyor. The peripheral constraint 150 includes a leading constraint unit 152 and trailing constraint unit 154 for each lane of the conveyor. The leading constraint unit 152 may be spaced from the trailing constraint unit by a distance 156 sufficient to allow a saw blade of the log saw to pass between the leading and trailing constraint units for cutting each log. The leading and trailing constraint units 152,154 may be similar in construction. Each constraint unit 152,154 may have right and left bottom support links 182 and right and left side support links 184. The right and left bottom support links and the right and left side support links may be mounted to a vertical portion 186*a* of a lower support frame 186. The bottom support links 182 may be pivotally connected to an arm 186*b* extending from vertical portion 186*a* of a lower support frame 186, while the side support links 184 may be pivotally connected to the bottom support links 182, respectively, and slideably connected to the lower support frame via a linkage 190 that may have a pin that cooperates with a curved slot of vertical portion 186*a* of the lower support frame 186. The leading constraint unit may have a lead-in chamfer formed at its forward face to receive an incoming log along the lane. The bottom support link may have a guide surface adapted to engage a region of a periphery of the convolutely wound log when the log is directed into the peripheral constraint. The guide surface of the bottom support link may be curved in a manner to approximate the average diameter of convolutely wound log to be conveyed in the conveyor. The side support link may have a guide surface adapted to engage another region of a periphery of the convolutely wound log when the log is directed into the peripheral constraint. The guide surface of the side support link may be curved in a manner to approximate the average diameter of convolutely wound log to be conveyed in the conveyor. While FIGS. 3-10 show right and left bottom support links and right and left side support links and linkages, the peripheral constraint may be constructed with one bottom support link and one side support link, or may be constructed with two bottom support links and one side support link depending upon the construction of the conveyor, the pusher, and the manner of advancement of the log in the conveyor.

A push/pull rod 188 may be connected to the linkage 190 and may be used to move the bottom and side support links 182,184, with a linkage actuation assembly as will be described below in greater detail. The support links 182, 184,190 comprise the rigid portion of the peripheral constraint. Moving the linkage 190 upwards in the drawings decreases the diameter setting of the rigid portion peripheral constraint, while moving the linkage 190 downwards in the drawings increases the diameter setting. The surfaces of the bottom support links 182 and side support links 184 may be curved so as to approximate the cylindrical outer surface of the log.

Figure 8:
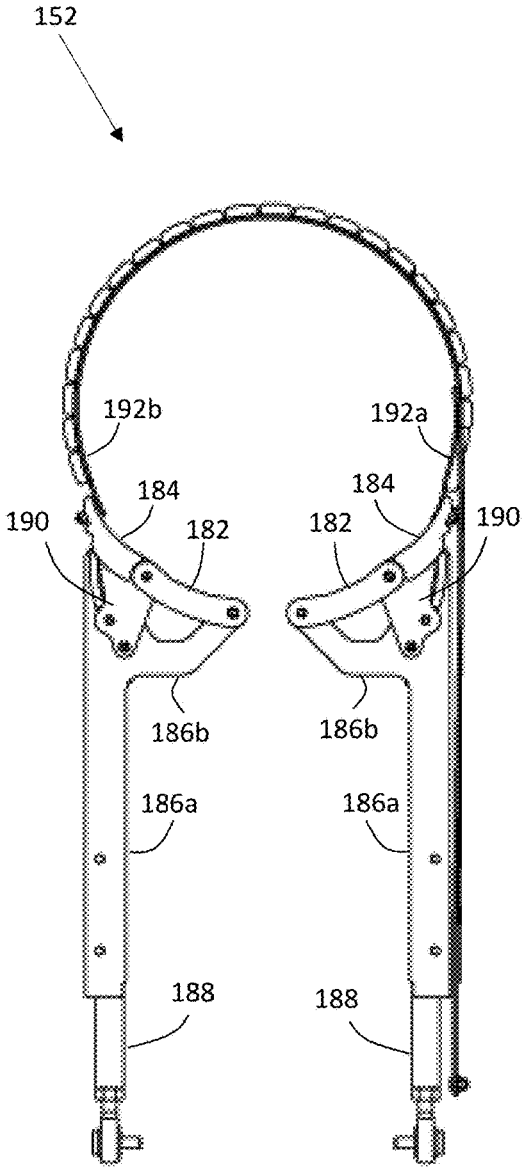
FIG. 8 is an elevation view of a downstream end of a leading constraint unit of the conveyor of FIG. 3.
Figure 9:
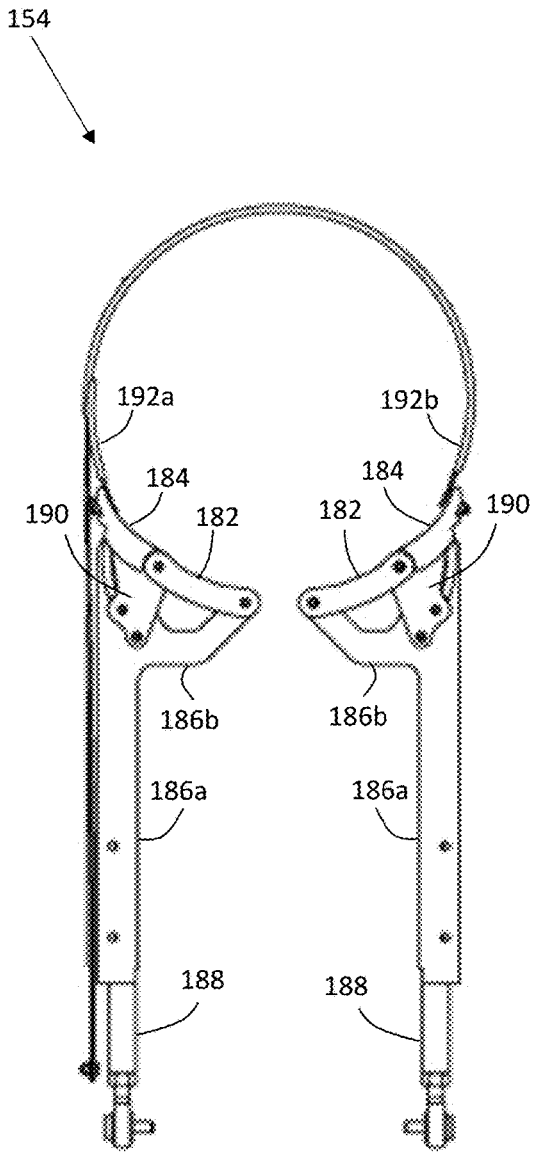
FIG. 9 is an elevation view of an upstream end of a trailing constraint unit of the conveyor of FIG. 3.
Figure 10:
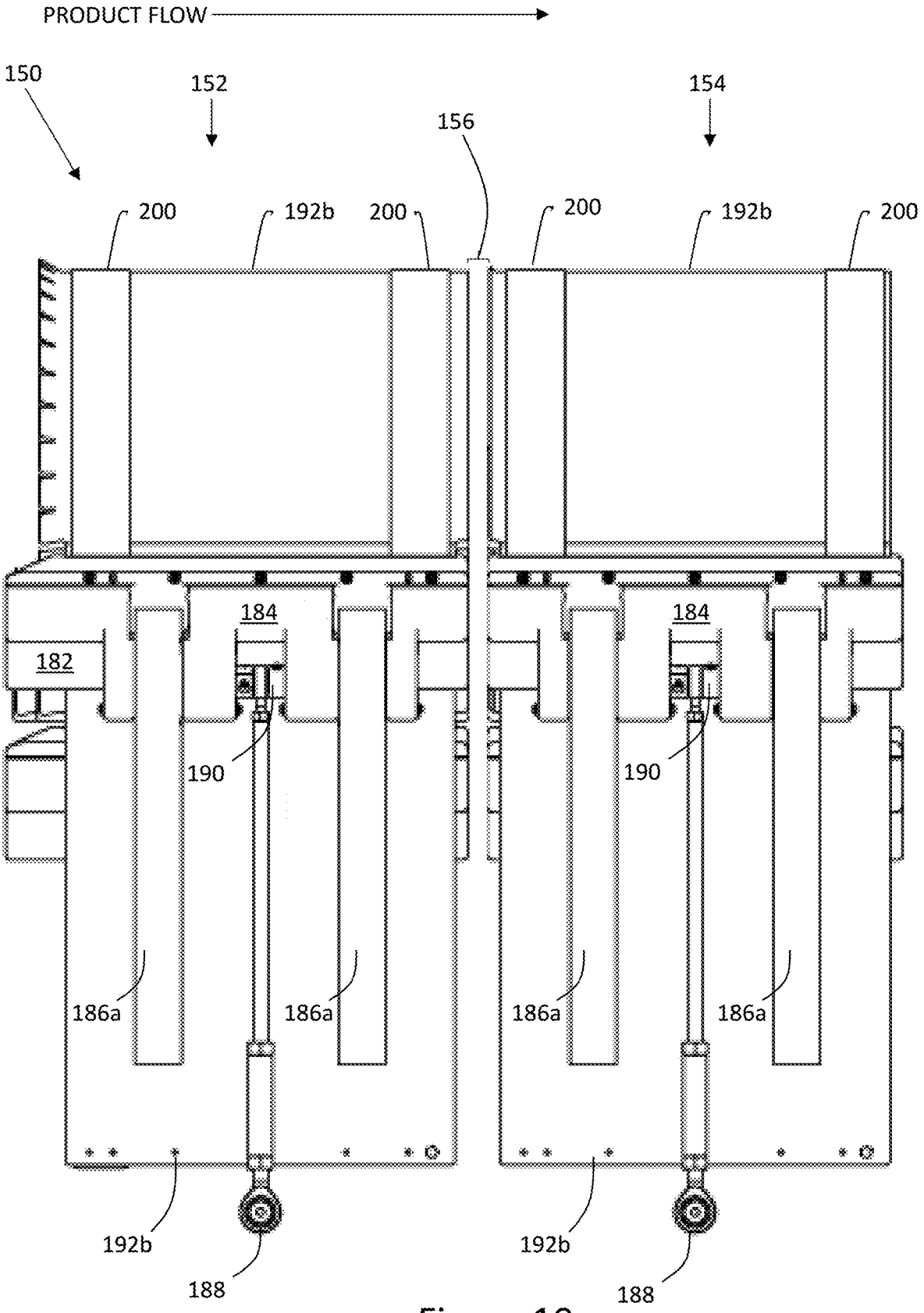
FIG. 10 is a side view of a peripheral constraint of the lane of the conveyor, and in particular, showing detail of a distal end of the push pull control rod and its connection to the push pull control rod actuator (not shown).
Figure 11:
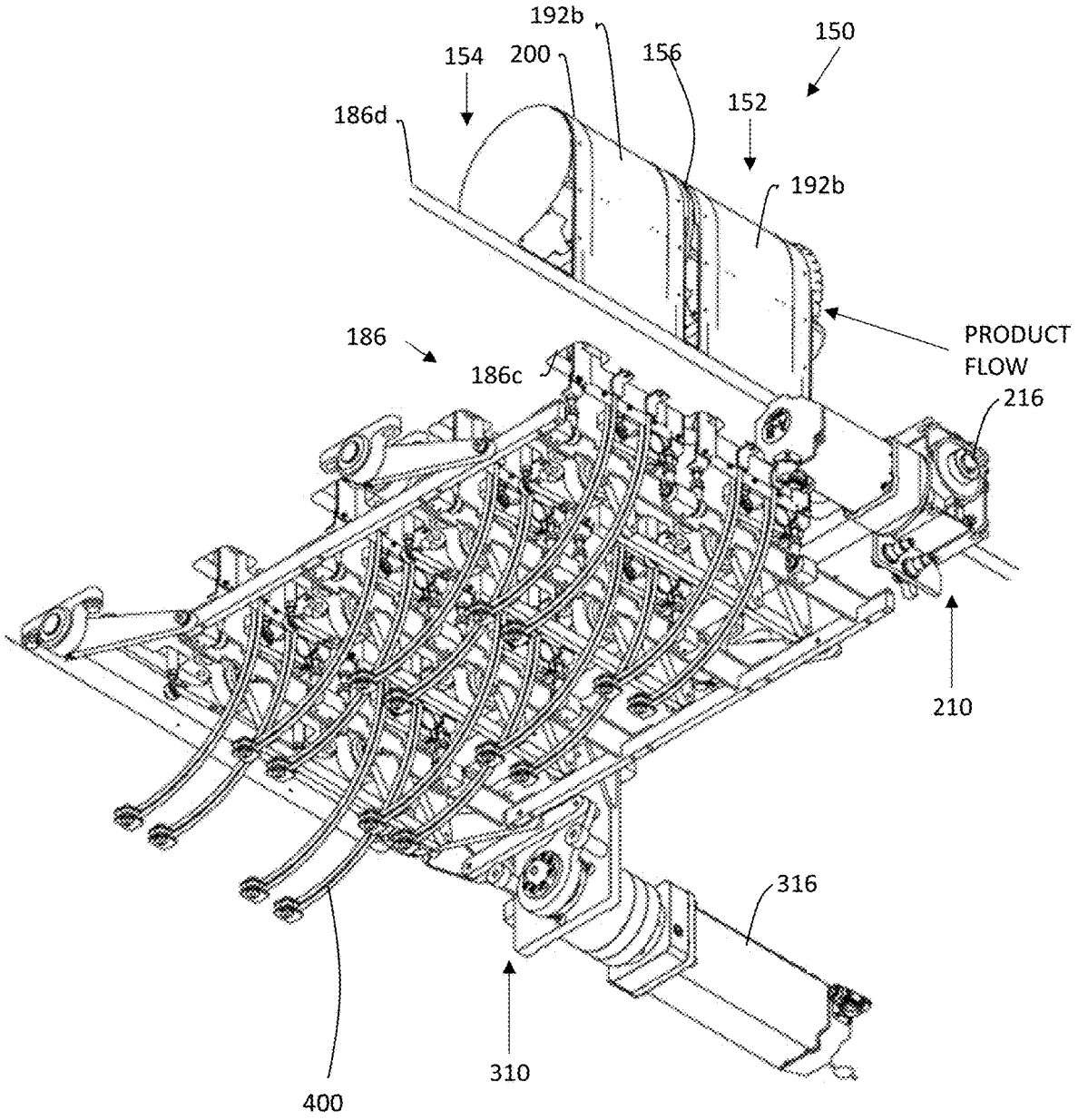
FIG. 11 is a perspective view of the push pull control rod actuator and the flexible member actuator for the four lane conveyor of FIG. 3 with a base of the lower support frame removed for ease of illustration.
Figure 12:
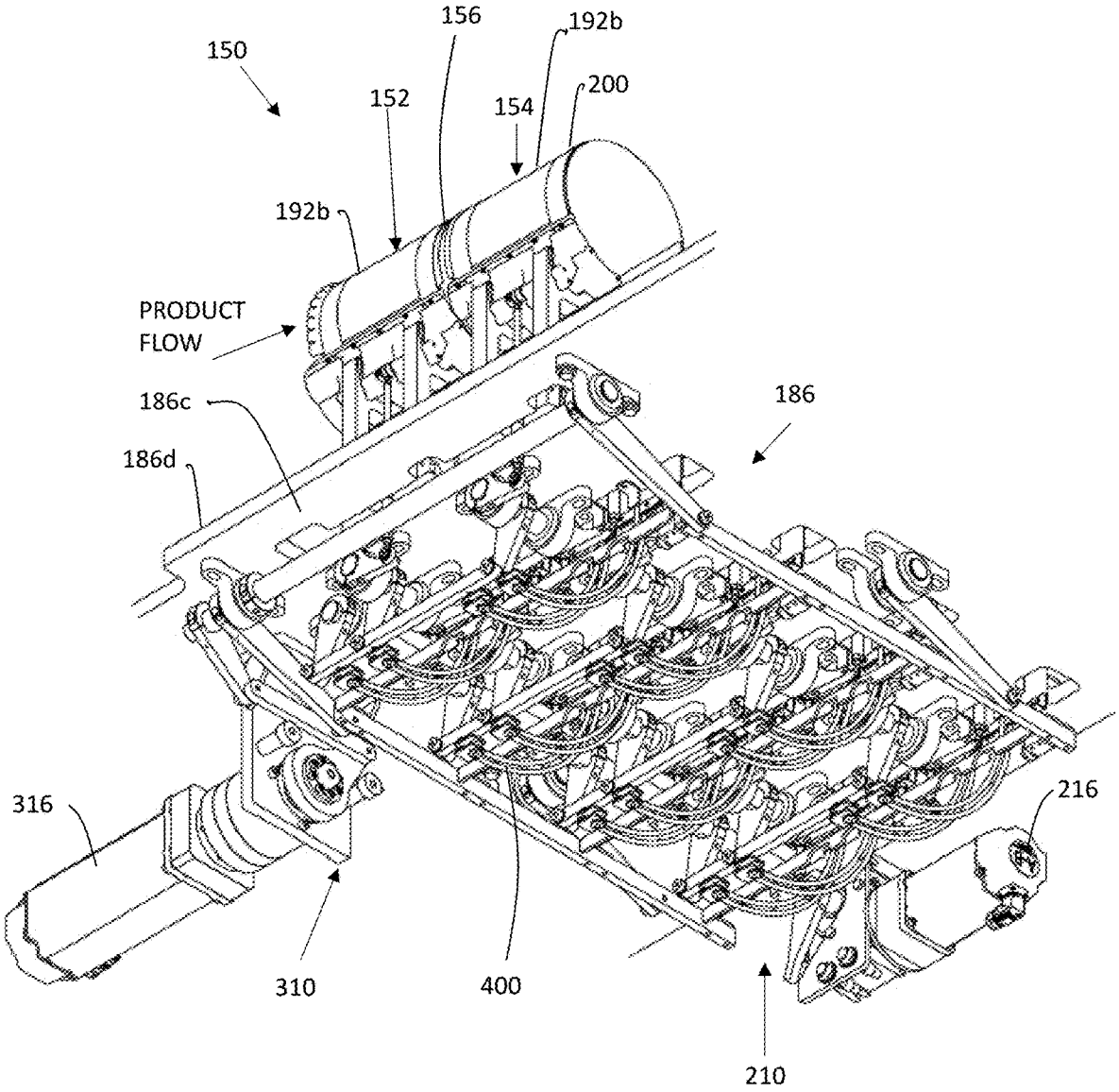
FIG. 12 is an alternative perspective view of the push pull control rod actuator and the flexible member actuator for the four lane conveyor of FIG. 3 with the base of the lower support frame removed for ease of illustration.

FIGS. 8 and 9 show an embodiment of a peripheral restraint with two flexible members 192*a*,192*b*. A shorter arcuate segment flexible member 192*a* may extend from a distal end of right side support link (right side in FIG. 8), substantially tangential to the surface thereof. To facilitate eventual replacement, the shorter flexible member 192*a* may be a separate part from the side support link as described above in reference to flexible member 92 and FIGS. 1 and 2. A longer flexible member 192*b* may extend from a distal end of the left side support link (left side in FIG. 8) and overlap with the shorter flexible member to form a bounded circular arc. The longer flexible member 192*b* which is on top of the shorter flexible member 192*a* in the drawings when the flexible members overlap may extend along the vertical portion 186*a* of the lower support frame 186 and through a slot 186*c* formed in the horizontal portion 186*d* of the lower support frame 186. The distal end of the longer flexible member 192*b* may be operatively connected to a flexible member actuation assembly as will be described in greater detail below.

The outer flexible members 192*b* may include a resilient banding 200. The resilient banding may be provided with the flexible member 192*b* to provide the flexible member with additional resistance to being forced into an arc shape. The resilient banding may comprise steel banding, for example, steel banding 1¼ inches wide by 0.031 inches thick. The resilient banding 200 may aid in changing the diameter setting of the clamps and cause the flexible member to spring to a desired shape when the diameter of the incoming log changes. The outer flexible member 192*b* and the resilient banding 200 may have a flare or lead-in at the log inlet side to allow for variation in the diameter or compressibility of the logs being cut. The resilient banding 200 may be placed over axially opposite extends of the outer flexible member 192*b*. The resilient banding may have a pre-formed arcuate shape the diameter of which may be altered by moving the flexible member actuation assembly as described below. The resilient banding may also be omitted on one or more of the constraint units 152,154.

Figure 13:
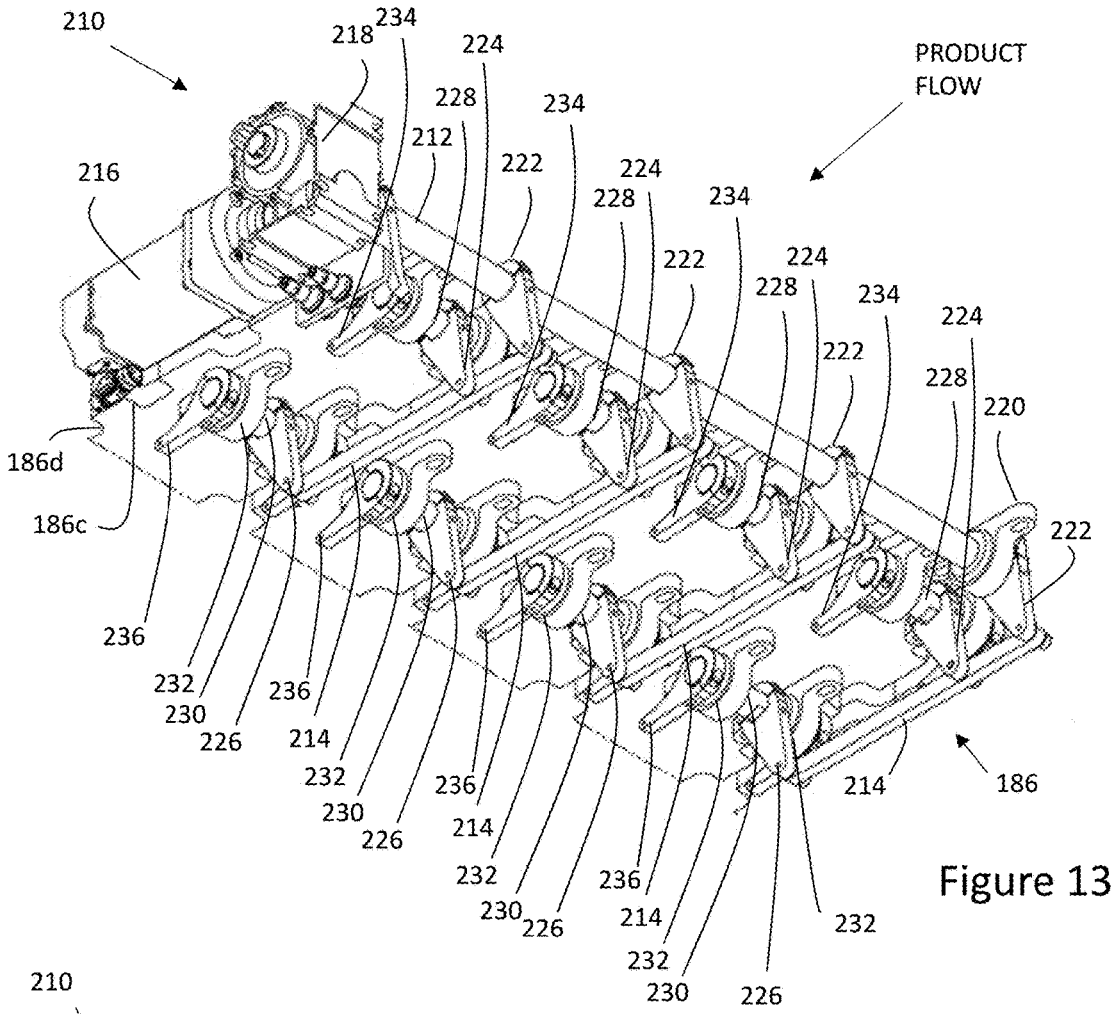
FIG. 13 is a perspective view of the push pull control rod actuator for the four lane conveyor of FIG. 3 with the base of the lower support frame and the flexible member actuator removed for ease of illustration.
Figure 14:
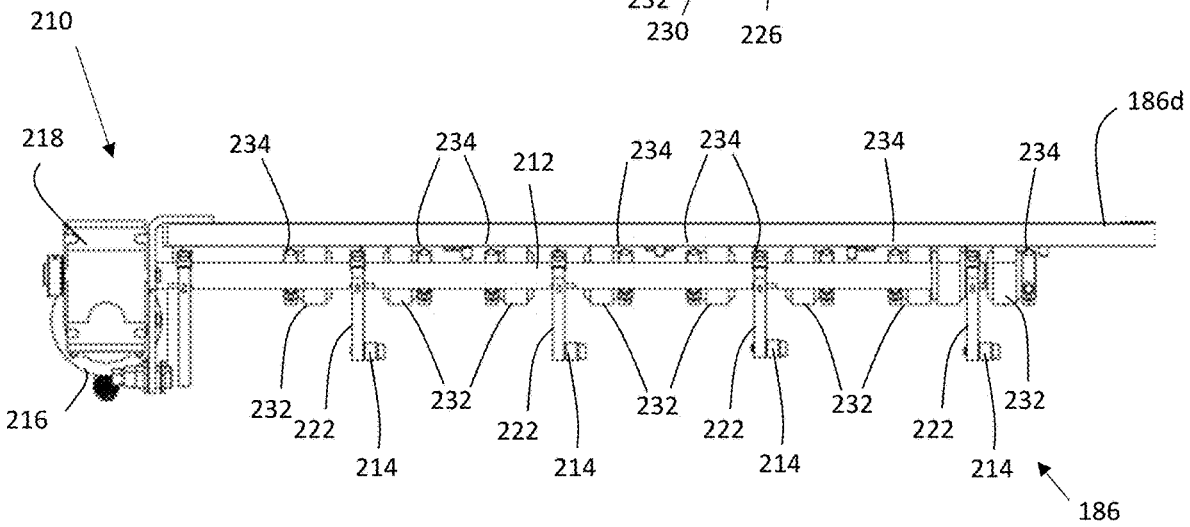
FIG. 14 is an elevation view of the push pull control rod actuator of FIG. 13.
Figure 15:
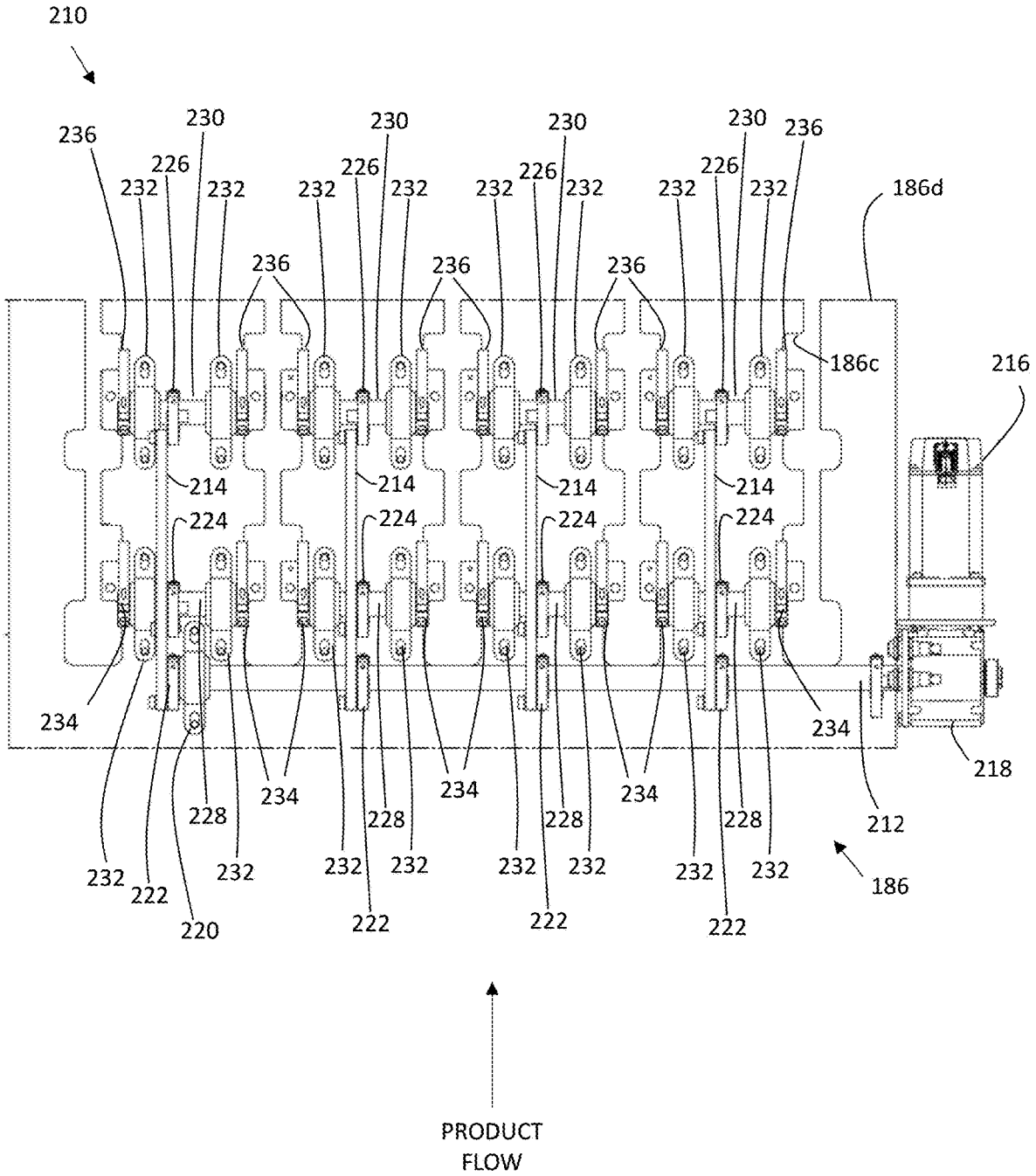
FIG. 15 is a bottom view of the push pull control rod actuator of FIG. 13 (i.e., the push pull control rod actuator mounted to a horizontal portion of the lower support frame).

As best shown in FIGS. 13-15, the push pull control rod actuation assembly 210 includes a transverse drive linkage 212 and a lane linkage 214 for each respective lane of the conveyor. The transverse drive linkage 212 may be driven by a servo motor 216 with a right angle head 218. The transverse drive linkage 212 may be supported for rotational motion by one or more pillow block bearings 220 mounted to an underside of the horizontal portion of the lower support frame. The servo motor 216 and the right angle head 218 may be mounted to an underside of the horizontal portion 186*d* of the lower support frame 186. Each lane linkage 214 may include a drive arm 222 keyed to the transverse drive linkage 212 so that rotation of the transverse drive linkage creates rotation of the drive arm 222 and the lane linkage 214. The lane linkage 214 may include first and second primary rocker arms 224,226 that are respectively keyed to shafts 228,230 associated with the leading constraint unit 152 and the trailing constraint unit 154. The first and second primary rocker arms 224,226 may be attached at generally the center of each their respective shafts 228,230, and each of the shafts may be supported for rotational motion by pillow block bearings 232 arranged generally adjacent to ends of the shaft. The pillow block bearings 232 may be mounted on the underside of the horizontal portion 186*c* of the lower support frame 186. The shaft 228,230 associated with the leading and trailing constraint units 152,154 may be keyed with first and second secondary rocker arms 234,236 arranged on axial opposite ends of each shaft (e.g., the leading constraint unit shaft and the trailing constraint unit shaft) outboard of the pillow block bearings 232. The first and second secondary rocker arms 234,236 may be operatively connected to the distal end of the push pull control rod 188. Thus, one lane linkage 214 may operatively drive the push pull control rods 188 and thus the left and right side linkages 190 of both the leading and trailing constraint units 152,154.

Making reference to FIG. 13, clockwise rotation of the transverse drive linkage 212 in turn causes clockwise rotation of the drive arm 222, the first and second primary rocker arms 224,226, clockwise rotation of the lane linkages 214, clockwise rotation of the shafts 228,230, and clockwise rotation of the first and second secondary rocker arms 234,236, which in turn causes upward motion of the push pull control rods 188 and an enlargement in the diameter defined by the linkages 182,184. Counter-clockwise rotation of the transverse linkage 212 causes counter-clockwise rotation of the drive arm 22, the first and second primary rocker arms 224,226, counter-clockwise rotation of the lane linkages 214, counter clockwise rotation of the shafts 228, 230, and counter clockwise rotation of the first and second secondary rocker arms 234,236, which in turn causes downward motion of the push pull control rods 188 and a reduction of the diameter defined by the linkages 182,184. The motion of the lane linkages 214 and the drive arm, the primary rocker arms 224,226 causes synchronous rotation of the shafts 228,230, and the secondary rocker arms 234,236, and synchronous motion of the push pull control rods 188 of the leading and trailing constraint units 152,154.

Figure 16:
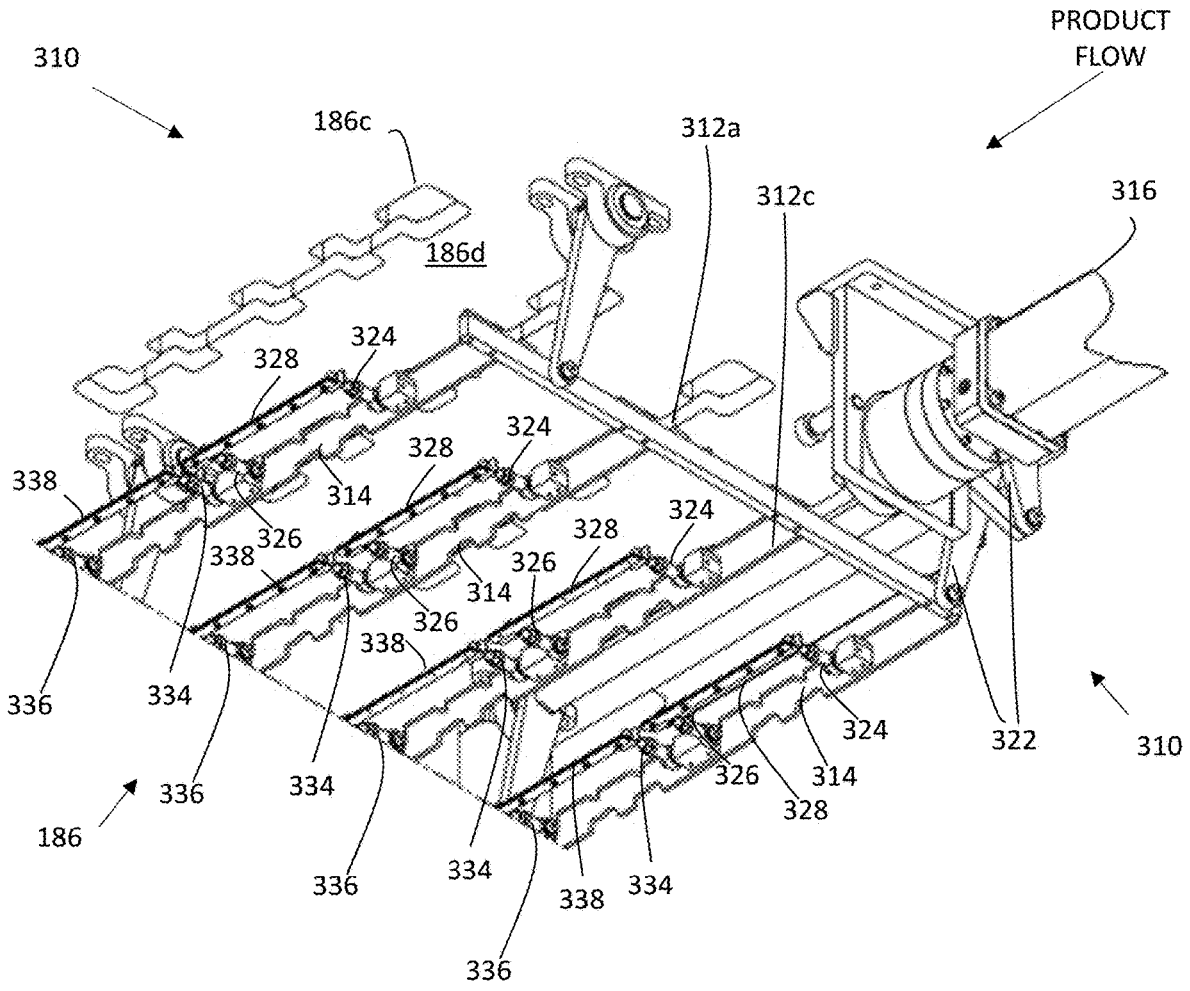
FIG. 16 is a perspective view of the flexible member actuator for the four lane conveyor of FIG. 3 with the base of the lower support frame and the push pull control rod actuator removed for ease of illustration.
Figure 17:
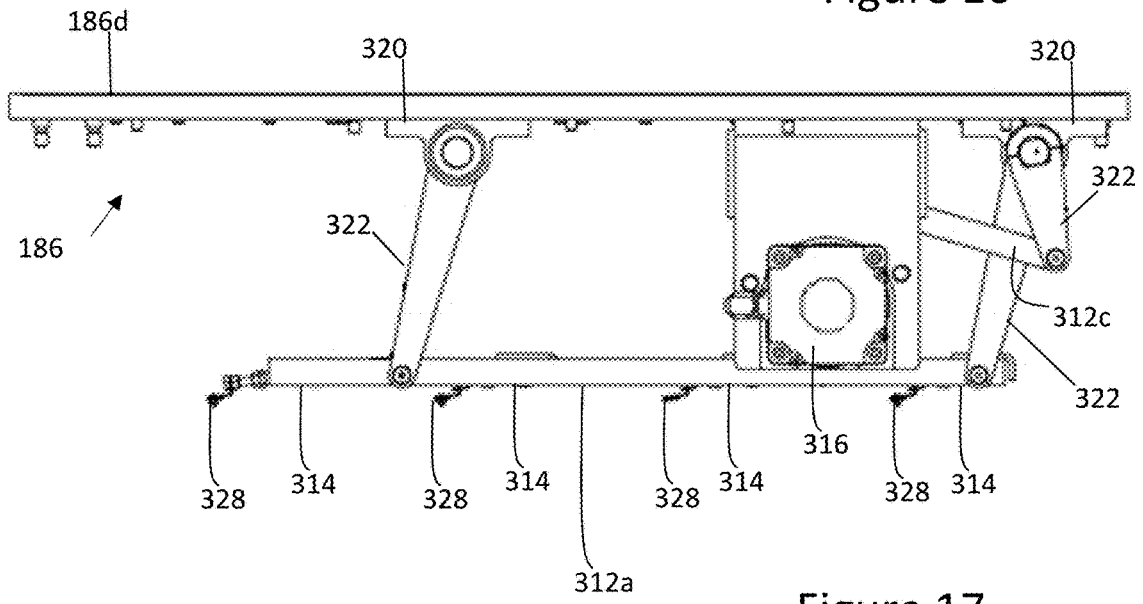
FIG. 17 is an elevation view of the flexible member actuator of FIG. 16.
Figure 18:
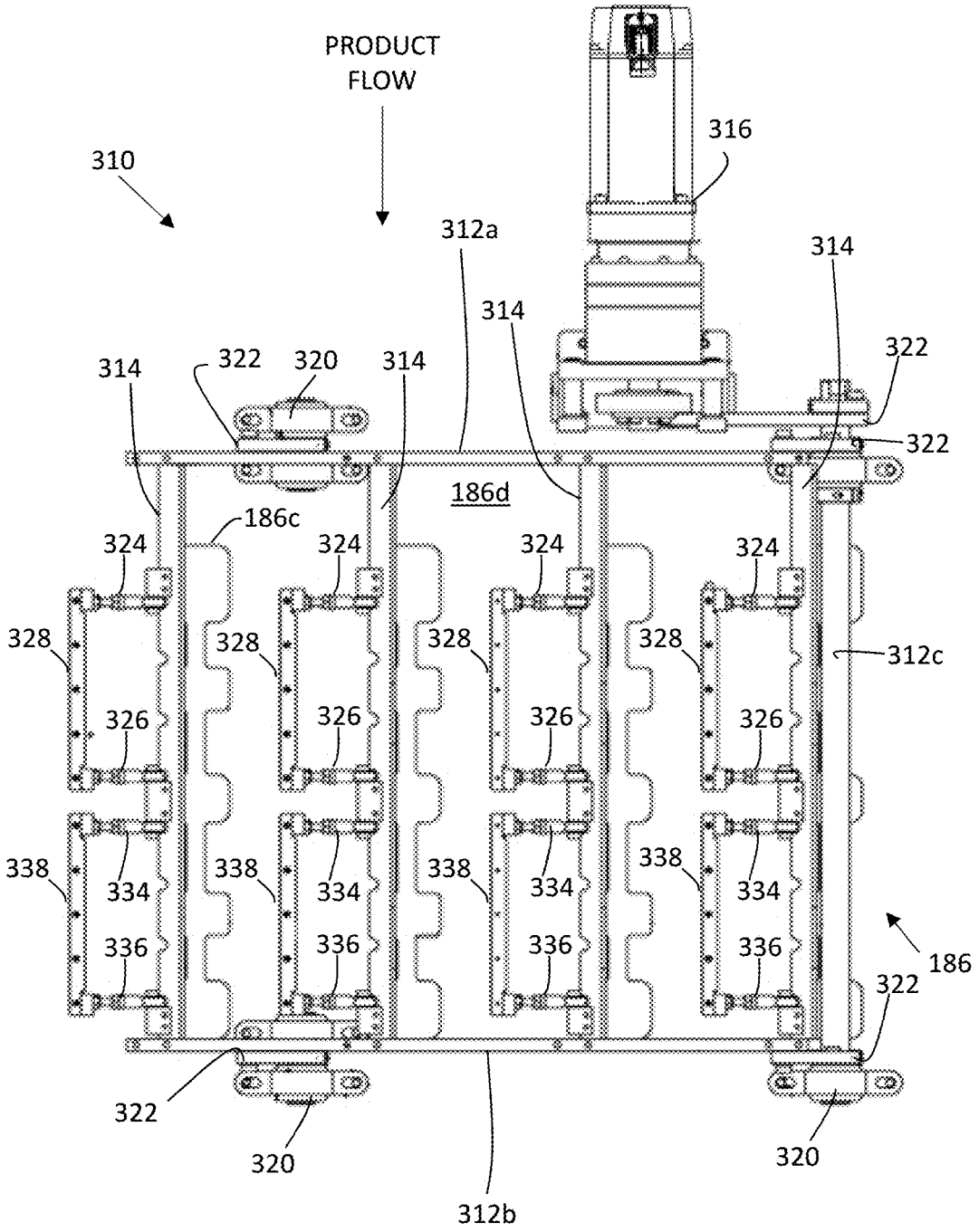
FIG. 18 is a bottom view of the flexible member actuator of FIG. 16 (i.e., the flexible member actuator mounted to a horizontal portion of the lower support frame).

As best shown in FIGS. 16-18, the flexible member actuation assembly 310 may include first and second transverse drive bars 312*a*,312*b*, and a lane riser 314 for each respective lane of the conveyor driven. One of the transverse drive bars 312*a* may be operatively connected to and driven by a servo motor 316. The opposite transverse drive bar 312*b* may be driven by the first transverse drive bar 312*a* via a cross drive bar 312*c*. The transverse drive bars 312*a*,312*b* and the cross drive bar 312*c* may be supported on the underside of the horizontal portion 186*d* of the lower frame support 186 by pillow block bearings 320 and swing arms 322. Each lane riser 314 extends between the first and second transverse drive bars 312*a*,312*b*. Each lane riser 314 may include a first set of two pivot arms 324,326 with an edging attachment 328 extending between the two pivot arms (for the leading constraint unit 154), and a second set of two pivot arms 334,336 with an edging attachment 338 extending between the two pivot arms (for the trailing constraint unit 154). The edging attachment 328,338 may be operatively connected to the distal end of the flexible member 192*b*, and the distal end of the resilient banding 200, if used.

Making reference to FIG. 17, clockwise rotation of the transverse drive bars 312*a*,312*b* causes clockwise rotation of the lane riser 314, which in turn causes upward motion of the edging attachment 328,338, the flexible member 192*b*, and the resilient banding 200 (if used), and thus, an enlargement in the diameter defined by the flexible member 192*b*, and the resilient banding 200. Counter-clockwise rotation of the transverse drive bars 312*a*,312*b* in turn causes counter-clockwise rotation of the lane risers 314, which in turn cause downward motion of the edging attachments 328,338, the flexible member 192*b* and the resilient banding 200, and thus, a reduction of the diameter defined by the flexible member and the resilient banding. The motion of the transverse drive bars 312*a*,312*b* and the lane risers 314 causes synchronous rotation of the pivot arms 324,326,334,336, and the edging attachments 328,338, and synchronous motion of the flexible member 192*b* and resilient banding 200 for each lane.

Figure 19:
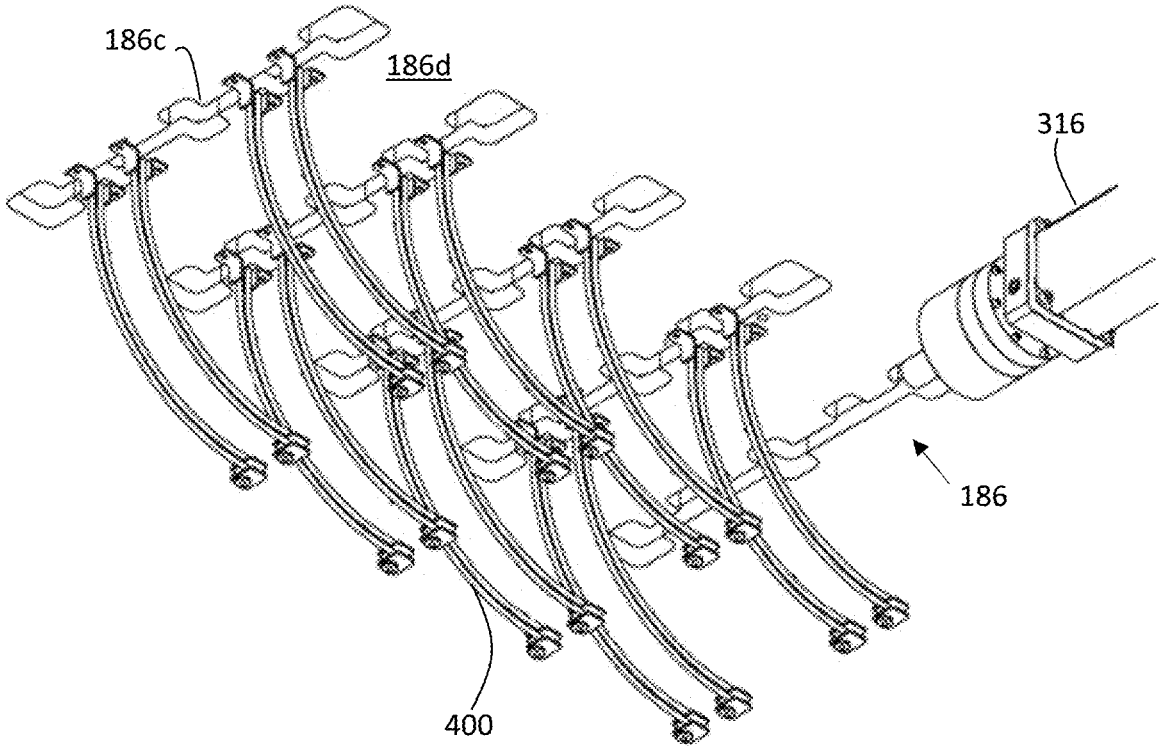
FIG. 19 is a perspective view of guide members for the flexible member for the four lane conveyor of FIG. 3 with the base of the lower support frame, the flexible member actuator, and the push pull control rod actuator removed for ease of illustration.
Figure 20:
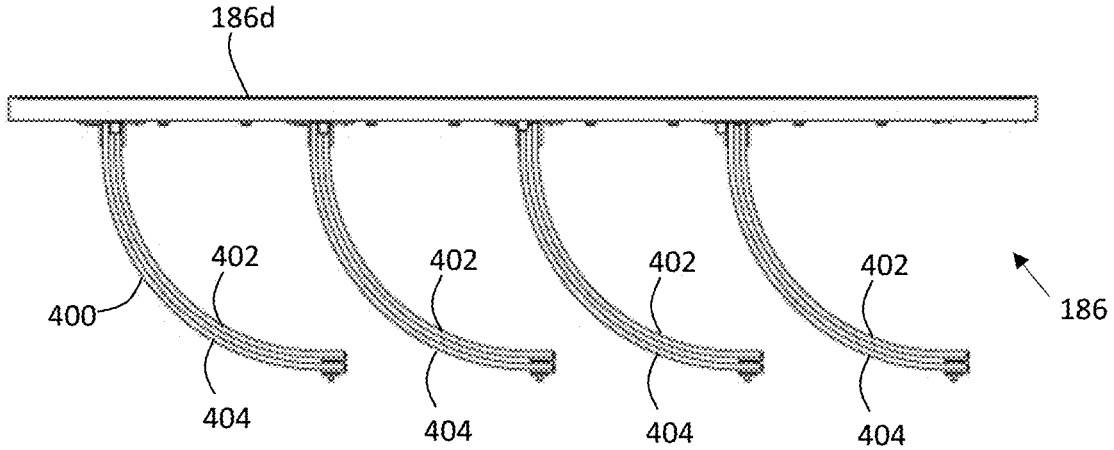
FIG. 20 is an elevation view of the guide members of FIG. 19.

The flexible member 192*b* (and resilient banding 200 if used) of each of the leading constraint unit 152 and trailing constraint unit 154 may be drawn through an arcuate guide 400 as shown in FIGS. 19 and 20. The edging attachment 328,338, and the flexible member 192*b* (and the resilient banding 200) may be disposed between top and bottom rails 402,404 of the arcuate guides. Movement of the lane riser 314 and rotation of the pivot arms 324,326,334,336 allows the edging attachment 328,338, and the flexible member 192*b* (and the resilient banding 200) to slide along the arcuate guides 400 as the diameter of the resilient banding and the flexible member is changed. The arcuate guides 400 may extend between the horizontal portion 186*d* of the lower support frame 186 and a base portion 186*e* of the lower support frame. Two arcuate guides 400 may be provided for each of the leading constraint unit 152 and the trailing constraint unit 154. The pivot arms of each of the lane risers 324,326,334,336 may be arranged outboard of the arcuate guides 400 to allow the pivot arms to pivot during motion of the lane riser 314 and transverse drive bars 312*a*,312*b* thereby drawing the flexible member (and the resilient banding) in an arcuate path below the horizontal portion of the lower support frame. The lane risers 314 may have cut-outs to accommodate the guides 400 during travel of the lane risers.

The diameter setting of the peripheral constraint(s) may be constant throughout a production run of a tissue or towel product. If required, the diameter setting of the peripheral constraint(s) may be increased while the log is being advanced, and decreased while the log is being cut. Examples of tissue log products that may necessitate cycling the peripheral constraints open and closed in this manner are: products with a high degree of variability in diameter or compressibility, where there is risk that a log would be too large to fit into the peripheral constraint, or fit too loosely in the peripheral constraint for a quality cut; and very firm products, such that the constraint force required for a quality cut would generate too much resistance to the log advancing through the peripheral constraint between cuts.

Figure 21:
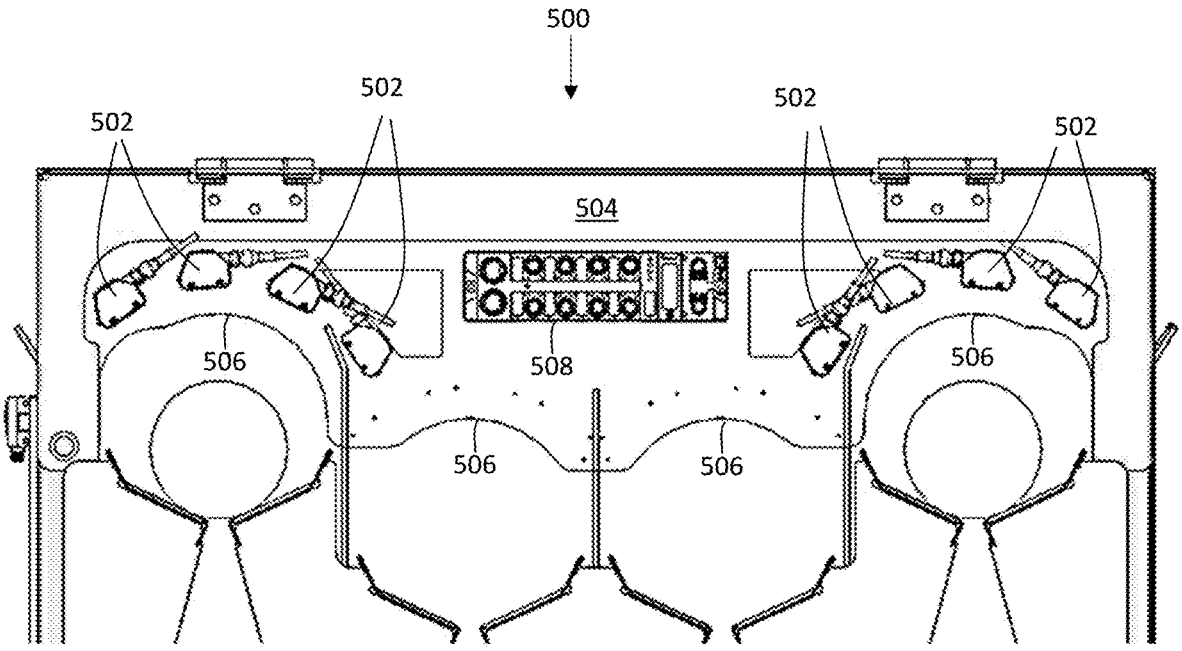
FIG. 21 is an elevation view of a clamp diameter measuring system arranged about the lanes of the conveyor of FIG. 3.

Referring to FIG. 21, the log saw conveyor may be provided with a clamp diameter measuring system 500 upstream of the peripheral constraint. The clamp diameter measuring system 500 may be positioned adjacent to one or more lanes of the conveyor to provide a real time measurement of the diameter of the logs being delivered from an accumulator/rewinder to the log saw prior to cutting. By measuring the diameter of the log incoming to the peripheral constraint and log saw, the push pull control rod actuation assembly 210 and the flexible member actuation assembly 310 may be adjusted as needed to set a diameter to accommodate the incoming log and peripheral restraint and support of the log during the cutting cycle. In one embodiment, the clamp diameter measuring system 500 may monitor a moving average of the diameter of the logs prior to entering the peripheral constraint. Thus, the peripheral constraints may be adjusted in real time based upon measurements relative to the moving average. The system 500 may be aligned so that there is a certain tolerance threshold or dead band before adjustment of the peripheral constraint may be made so as to limit the amount of adjustment.

The clamp diameter measuring system 500 may be configured to measure log diameter in multiple ways including through the use of one or more optical sensors 502 (as shown in FIG. 21) or contact gages. Optical sensors 502 may be used to measure the diameter while contact gauges may be used to capture a combination of firmness and/or diameter. The contact sensors may include any one or a combination of the left and right side linkages 184, the left and right bottom linkages 184, the flexible member 192,192*b*, and/or the resilient banding 200. As shown in FIG. 21, the optical sensors 502 are mounted on a support plate 504. The support plate 504 may include passageways 506 for each lane of the conveyor to allow the log and the pusher to travel on the conveyor toward the log saw. The support plate 504 may arranged across the lanes of the conveyor with the sensors 502 in sufficient proximity to the incoming log to sense the diameter of the logs passing in the lane of the conveyor. The sensor output may be directed to a control 508 which in turn sends control signals to at least one of the push pull control rod actuation assembly 210 and the flexible member actuation assembly 310 to change the diameter of the peripheral constraint as needed. More in particular, the control signals may be directed to one or both of the respective servo motors 216,316 associated with the push pull control rod actuation assembly 210 and the flexible member actuation assembly 310 to change the diameter of the peripheral constraint as needed. The optical sensors may be provided by Banner Engineering Corp. of Minneapolis, Minn.

Further embodiments can be envisioned by one of ordinary skill in the art after reading this disclosure. In other embodiments, combinations or sub-combinations of the above-disclosed invention can be advantageously made. The example arrangements of components are shown for purposes of illustration and it should be understood that combinations, additions, re-arrangements, and the like are contemplated in alternative embodiments of the present invention. Thus, various modifications and changes may be made thereunto without departing from the broader spirit and scope of the invention as set forth in the claims and that the invention is intended to cover all modifications and equivalents within the scope of the following claims.

What is claimed is:

1. An apparatus for supporting a convolutely wound log of web material during cutting of the convolutely wound log, the apparatus comprising:

a support frame, a bottom support link being operatively coupled to the support frame, the bottom support link having a guide surface adapted to engage a region of a periphery of the convolutely wound log when the log is directed into the apparatus, and a side support link being operatively pivotally coupled to the support frame, the side support link being operatively pivotally coupled to the bottom support link, the side support link having a guide surface adapted to engage a further region of the periphery of the convolutely wound log when the log is directed into the apparatus; and a flexible member operatively coupled to a distal end of the side support link, the flexible member extending tangentially from the guide surface of the side support link and curving away from the side support link and the bottom support link so that a portion of the flexible member is spaced away from the guide surface of the side support link and the guide surface of the bottom support link, the spaced away portion of the flexible member being adapted to engage a second further region of the periphery of the convolutely wound log when the log is directed into the apparatus, the spaced away portion of the flexible member together with the guide surface of the side support link and the guide surface of the bottom support link at least in part defining a support surface for supporting the convolutely wound log when the log is directed into the apparatus.

2. The apparatus of claim 1, wherein the flexible member is detachably mounted to the side support link.

3. The apparatus of claim 2, wherein the flexible member is detachably mounted such that the flexible member is flush with the guide surface of the side support link.

4. The apparatus of claim 1, wherein at least one of the side support link and the flexible member are operatively connected to an actuator, the actuator being adapted and configured to move the at least one of the side support link and the flexible member relative to the support frame.

5. The apparatus of claim 4, wherein the actuator is operatively electrically connected with a log sensor, the log sensor is adapted and configured to sense a diameter of a convolutely wound log directed into the apparatus, generate a signal representative of the log diameter, and transmit the signal to a control associated with the flexible member actuator.

6. The apparatus of claim 1, further comprising:

a further bottom support link being operatively pivotally coupled to the support frame, the further bottom support link having a guide surface adapted to engage a third further region of the periphery of the convolutely wound log when the log is directed into the apparatus, and a further side support link being operatively pivotally coupled to the support frame, the further side support link being operatively pivotally coupled to the further bottom support link, the further side support link having a guide surface adapted to engage a fourth further region of the periphery of the convolutely wound log when the log is directed into the apparatus.

7. The apparatus of claim 6, further comprising a further flexible member, the further flexible member being operatively coupled to a distal end of the further side support link, the further flexible member extending tangentially from the guide surface of the further side support link and curving away from the further side support link and the further bottom support link, a section of the flexible member overlapping the further flexible member, the further flexible member together with the spaced away portion of the flexible member, the guide surface of the side support link, the guide surface of the bottom support link, the guide surface of the further side support link, and the guide surface of the further bottom support link at least in part defining a support surface for supporting the convolutely wound log when the log is directed into the apparatus.

8. The apparatus of claim 7, wherein the further flexible member is detachably mounted to the further side support link.

9. The apparatus of claim 7, wherein the flexible member and the further flexible member are of different lengths.

10. The apparatus of claim 7, further comprising a second further flexible member overlapping the flexible member.

11. The apparatus of claim 10 wherein the second further flexible member has sufficient resiliency such that the flexible member conforms to the shape of the second further flexible member.

12. The apparatus of claim 1 wherein the side support link is operatively slideably connected to the support frame.

13. An apparatus for supporting a convolutely wound log of web material during cutting of the convolutely wound log, the apparatus comprising:

a support frame, a first bottom support link being operatively pivotally coupled to the support frame, the first bottom support link having a guide surface adapted to engage a first region of a periphery of the convolutely wound log when the log is directed into the apparatus, a second bottom support link being operatively pivotally coupled to the support frame, the second bottom support link having a guide surface adapted to engage a second region of a periphery of the convolutely wound log when the log is directed into the apparatus;

a side support link being operatively pivotally coupled to the support frame, the side support link being operatively pivotally coupled to one of the first and second bottom support link, the side support link having a guide surface adapted to engage a third region of the periphery of the convolutely wound log when the log is directed into the apparatus; and a flexible member operatively coupled to a distal end of the side support link, the flexible member extending tangentially from the guide surface of the side support link and curving away from the side support link and the respective one of the first and second bottom support link so that a portion of the flexible member is spaced away from the guide surface of the side support link and the guide surface of the respective one of the first and second bottom support link, the spaced away portion of the flexible member being adapted to engage a fourth region of the periphery of the convolutely wound log when the log is directed into the apparatus, the spaced away portion of the flexible member together with the guide surface of the side support link and the guide surface of the respective one of the first and second bottom support link at least in part defining a support surface for supporting the convolutely wound log when the log is directed into the apparatus.

14. The apparatus of claim 13, wherein at least one of the side support link and the flexible member are operatively connected to an actuator, the actuator being adapted and configured to move the at least one of the side support link and the flexible member relative to the support frame.

15. The apparatus of claim 14, wherein the actuator is operatively electrically connected with a log sensor, the log sensor is adapted and configured to sense a diameter of a convolutely wound log directed into the apparatus, generate a signal representative of the log diameter, and transmit the signal to a control associated with the flexible member actuator.

16. The apparatus of claim 13, further comprising a second side support link being operatively pivotally coupled to the support frame, the second side support link being operatively pivotally coupled the second bottom support link, the second side support link having a guide surface adapted to engage a fifth region of the periphery of the convolutely wound log when the log is directed into the apparatus.

17. The apparatus of claim 16, further comprising a further flexible member, the further flexible member operatively coupled to a distal end of the second side support link, the further flexible member extending tangentially from the guide surface of the second side support link and curving away from the second side support link and the second bottom support link, a section of the flexible member overlapping the further flexible member, the further flexible member being adapted to engage a sixth region of the periphery of the convolutely wound log when the log is directed into the apparatus, the further flexible member together with the spaced away portion of the flexible member, the guide surfaces of the first and second side support links, and the guide surfaces of the first and second bottom support links, at least in part defining a support surface for supporting the convolutely wound log when the log is directed into the apparatus.

18. The apparatus of claim 17, wherein the flexible member and the further flexible member are of different lengths.

19. The apparatus of claim 17, further comprising a second further flexible member overlapping the flexible member.

20. The apparatus of claim 19 wherein the second further flexible member has sufficient resiliency such that the flexible member conforms to the shape of the second further flexible member.

21. The apparatus of claim 13 wherein the side support link is operatively slideably connected to the support frame.

22. An apparatus for supporting a convolutely wound log of web material during cutting of the convolutely wound log, the apparatus comprising:

a support frame, a bottom support link being operatively coupled to the support frame, the bottom support link having a guide surface adapted to engage a region of a periphery of the convolutely wound log when the log is directed into the apparatus, and a flexible member operatively coupled to a distal end of the bottom support link, the flexible member extending tangentially from the guide surface of the bottom support link and curving away from the bottom support link so that a portion of the flexible member is spaced away from the guide surface of the bottom support link, the spaced away portion of the flexible member being adapted to engage a further region of the periphery of the convolutely wound log when the log is directed into the apparatus, the spaced away portion of the flexible member together with the guide surface of the bottom support link at least in part defining a support surface for supporting the convolutely wound log when the log is directed into the apparatus.

23. The apparatus of claim 22, wherein the flexible member is detachably mounted to the bottom support link.

24. The apparatus of claim 23, wherein the flexible member is detachably mounted such that the flexible member is flush with the guide surface of the side support link.

25. The apparatus of claim 22, wherein at least one of the bottom support link and the flexible member are operatively connected to an actuator, the actuator being adapted and configured to move the at least one of the bottom support link and the flexible member relative to the support frame.

26. The apparatus of claim 22, further comprising a second bottom support link, the second bottom support link having a guide surface adapted to engage a further region of a periphery of the convolutely wound log when the log is directed into the apparatus.

* * * * *